US009334633B2

(12) United States Patent
Harris et al.

(10) Patent No.: US 9,334,633 B2
(45) Date of Patent: May 10, 2016

(54) ROUGH-IN ASSEMBLY FOR FREE-STANDING TUB FILLER

(71) Applicant: MASCO CORPORATION OF INDIANA, Indianapolis, IN (US)

(72) Inventors: Curtis H. Harris, Anderson, IN (US); Scott K. Jones, Westfield, IN (US); Adam M. DeVries, Anderson, IN (US)

(73) Assignee: Delta Faucet Company, Indianapolis, IN (US)

( * ) Notice: Subject to any disclaimer, the term of this patent is extended or adjusted under 35 U.S.C. 154(b) by 429 days.

(21) Appl. No.: 13/828,494

(22) Filed: Mar. 14, 2013

(65) Prior Publication Data

US 2014/0259383 A1 Sep. 18, 2014

(51) Int. Cl.
*E03C 1/04* (2006.01)

(52) U.S. Cl.
CPC ..... *E03C 1/0403* (2013.01); *E03C 1/04* (2013.01); *E03C 1/0401* (2013.01); *Y10T 29/49826* (2015.01)

(58) Field of Classification Search
CPC ..... E03C 1/0404
USPC ..... 4/675–678; 29/428
See application file for complete search history.

(56) References Cited

U.S. PATENT DOCUMENTS

| | | | | | |
|---|---|---|---|---|---|
| 1,057,763 | A * | 4/1913 | Mueller | 29/525.03 |
| 1,466,895 | A * | 9/1923 | Edelman | E03C 1/232 4/674 |
| 2,264,876 | A * | 12/1941 | Hackley | 137/606 |
| 2,464,645 | A * | 3/1949 | Lassa | 4/584 |
| 2,637,044 | A * | 5/1953 | Low | 4/695 |
| 3,084,349 | A * | 4/1963 | Sundblad et al. | 4/676 |
| 3,583,368 | A * | 6/1971 | Mandelhaum et al. | 119/603 |
| RE29,054 | E | 11/1976 | Lange | |
| 4,069,523 | A * | 1/1978 | Ridgeway | 4/580 |
| 4,211,216 | A * | 7/1980 | Burgess et al. | 4/541.4 |
| 4,932,686 | A * | 6/1990 | Anderson, Jr. | 285/24 |
| 5,024,469 | A | 6/1991 | Aitken et al. | |
| 5,125,623 | A * | 6/1992 | Kiedinger | 251/295 |
| 5,160,174 | A * | 11/1992 | Thompson | 285/32 |
| 5,524,935 | A * | 6/1996 | Everts | 285/23 |
| 5,697,393 | A * | 12/1997 | Mirlisena, Sr. | 137/15.02 |
| 6,195,818 | B1 * | 3/2001 | Rodstein et al. | 4/678 |
| 6,823,539 | B1 * | 11/2004 | Bantz | 4/675 |
| 7,921,482 | B2 * | 4/2011 | Shafik | 4/681 |
| 7,987,869 | B2 * | 8/2011 | Rosko et al. | 137/315.15 |
| 2006/0242758 | A1 * | 11/2006 | Hall | 4/601 |
| 2008/0105305 | A1 * | 5/2008 | Lum et al. | 137/337 |
| 2009/0007975 | A1 * | 1/2009 | Lum et al. | 137/597 |
| 2009/0211021 | A1 * | 8/2009 | Gabriele | 4/678 |

OTHER PUBLICATIONS

Brochure and Specifications for Marcelle 04506-697 Free-Standing Tub Filler; Waterdecor; Copyright 2012.

(Continued)

*Primary Examiner* — Lori Baker

(74) *Attorney, Agent, or Firm* — Faegre Baker Daniels LLP

(57) ABSTRACT

A tub filler faucet assembly for coupling to a floor includes a spout, a mounting assembly, and a rough-in assembly. The mounting assembly is coupled to the spout and the rough-in assembly. The rough-in assembly is positioned below the floor.

24 Claims, 19 Drawing Sheets

(56) References Cited

OTHER PUBLICATIONS

Brochure and Specifications for Bridge 03304-697 High Arc Free-Standing Tub Filler; Waterdecor; Copyright 2012.

Service Parts for Nirvana 02201-697 Free Standing Tub-Filler with Hand Shower; Waterdecor; Copyright 2006.

* cited by examiner

ROUGH-IN ASSEMBLY FOR FREE-STANDING TUB FILLER

BACKGROUND AND SUMMARY OF THE DISCLOSURE

The present invention relates generally to faucets and, more particularly, to rough-in assemblies for free-standing tub fillers.

A tub filler assembly is configured with a spout to provide water to a tub. The spout may be mounted to the wall or floor. For example, if the tube is a free-standing tub, such as a roman tub or a claw-foot tub, a free-standing tub filler assembly may be mounted to the floor and positioned outside of the tub. The free-standing tub filler assembly may be supported above the floor by coupling a lower portion of the tub filler assembly to the top surface of the floor. The tub filler assembly is fluidly coupled to a plumbing supply in order to provide water to the spout.

The present disclosure relates to a tub filler faucet assembly for coupling to a floor. The tub filler faucet assembly includes a spout, a mounting assembly, and a rough-in assembly. The mounting assembly is coupled to the spout and the rough-in assembly. The rough-in assembly is positioned below the floor.

Another embodiment of the present disclosure includes a tub filler faucet assembly which is configured to couple with a floor. The tub filler faucet assembly comprises a spout, a mounting assembly, and a rough-in assembly. The mounting assembly is coupled to the spout and the rough-in assembly. The rough-in assembly includes a base member coupled to the floor and a cover member coupled to the base member. At least a portion of the cover member is removable when the base member is coupled to the floor.

A further embodiment of the present disclosure includes a method of installing a tub filler faucet assembly. The method comprises positioning a rough-in assembly below a floor and coupling the rough-in assembly to a water supply assembly. Additionally, the method comprises supporting a mounting assembly above the floor and coupling the mounting assembly to a spout.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The foregoing aspects and many of the intended advantages of this invention will become more readily appreciated as the same becomes better understood by reference to the following detailed description when taken in conjunction with the accompanying drawings.

Figure 1:
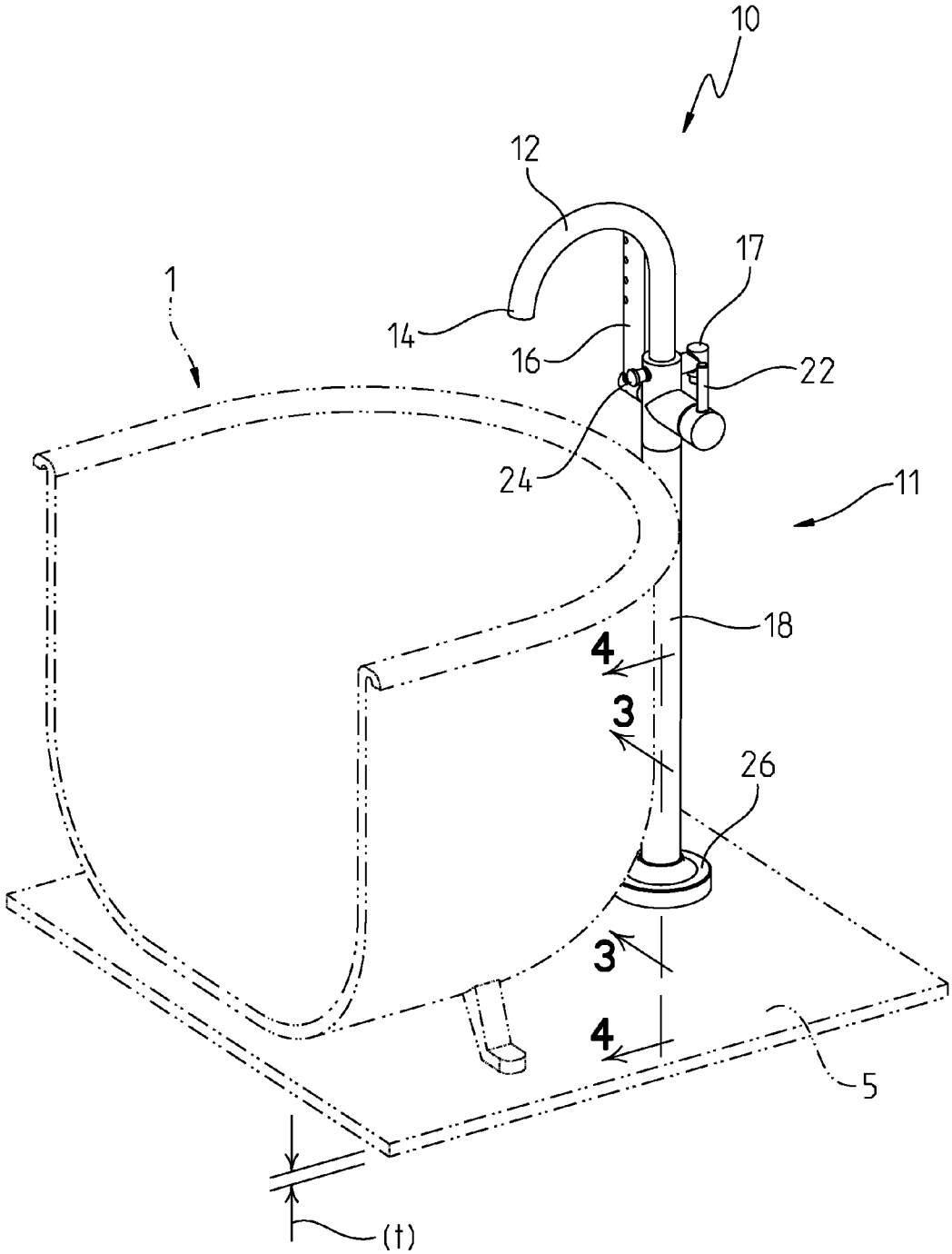
FIG. 1 is a front perspective view of an illustrative single-handle tub filler assembly of the present disclosure, the tub filler is positioned adjacent a tub illustrated in cross-section.

Corresponding reference characters indicate corresponding parts throughout the several views. Although the drawings represent embodiments of various features and components according to the present disclosure, the drawings are not necessarily to scale and certain features may be exaggerated in order to better illustrate and explain the present disclosure. The exemplifications set out herein illustrate embodiments of the invention, and such exemplifications are not to be construed as limiting the scope of the invention in any manner.

DETAILED DESCRIPTION OF THE DRAWINGS

For the purposes of promoting an understanding of the principals of the invention, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. It will be understood that no limitation of the scope of the invention is thereby intended. The invention includes any alterations and further modifications in the illustrative devices and described methods and further applications of the principles of the invention which would normally occur to one skilled in the art to which the invention relates.

Figure 2:
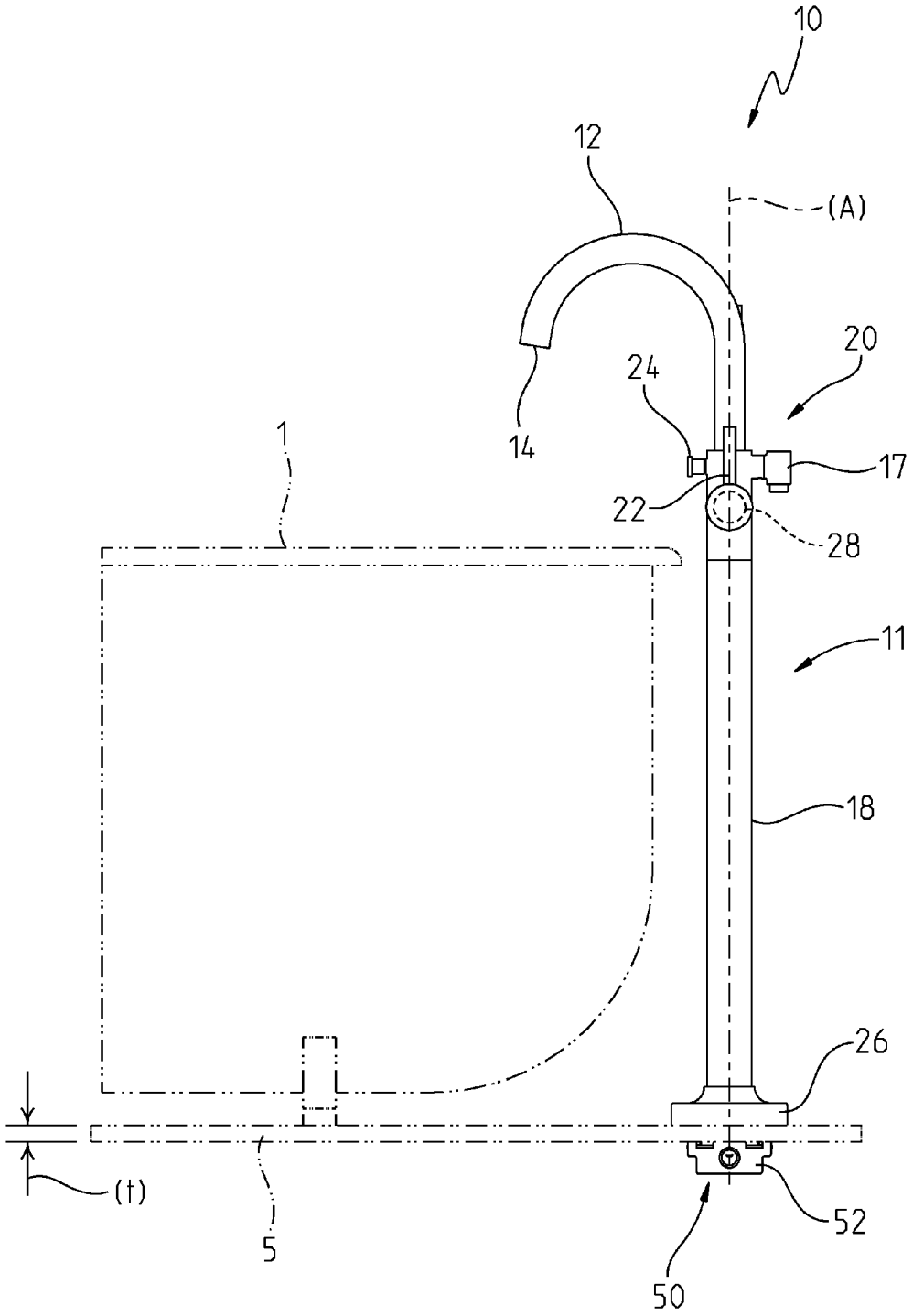
FIG. 2 is a side view of the tub filler assembly and tub of FIG. 1.

Referring to FIGS. 1 and 2, an illustrative single-handle tub filler assembly 10 is coupled to a floor 5 or other ground surface for providing water to a tub 1. Illustrative tub filler assembly 10 is a free-standing assembly positioned along an edge of tub 1. Tub filler assembly 10 includes a mounting assembly 11, a spout 12 having an outlet 14, a valve assembly 20, and a rough-in assembly 50. Floor 5 includes any finished flooring surface 5*a* (e.g., tile, carpet, laminate, hardwood, or other finishing surfaces) and subfloor structure 5*b* (e.g., plywood, concrete, or other structure) selected by a user. As is known, subfloor structure 5*b* is positioned below finished flooring surface 5*a* and is coupled thereto to support finished flooring surface 5*a*. Illustratively, floor 5 includes a thickness (t).

Figure 4:
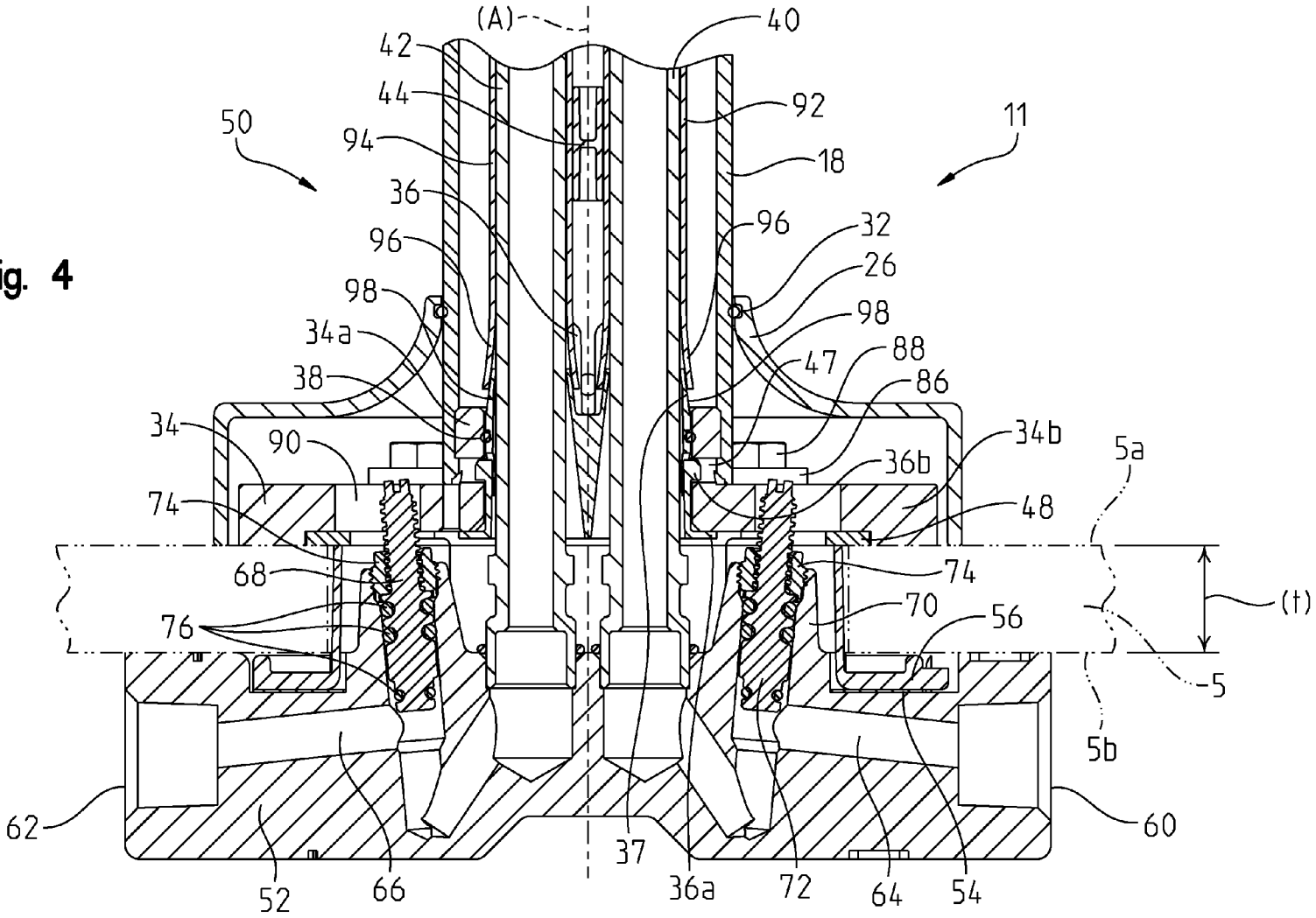
FIG. 4 is a further cross-sectional view of the rough-in assembly and the mounting assembly of the tub filler assembly of FIG. 1, taken along line 4-4 of FIG. 1.

Valve assembly 20 includes a handle 22, a diverter valve 24, and a mixing valve 28 (FIG. 2). Mixing valve 28 is fluidly coupled to a hot water inlet tube 40 and a cold water inlet tube 42, as shown in FIG. 4. Handle 22 is operably coupled to mixing valve 28 and the position of handle 22 may be adjusted to vary at least the temperature and/or flow rate of the water at outlet 2.

In one embodiment, tub filler assembly 10 includes a sprayhead 16. Sprayhead 16 receives water from valve assembly 20 through a hose (not shown) coupled to an inlet 17. Diverter valve 24 allows a user to toggle or switch between water flow from outlet 2 and water flow from sprayhead 16. Additional modes for both spout 12 and/or sprayhead 16 may be defined and accessed with diverter valve 24 or any other conventional means.

Figure 3:
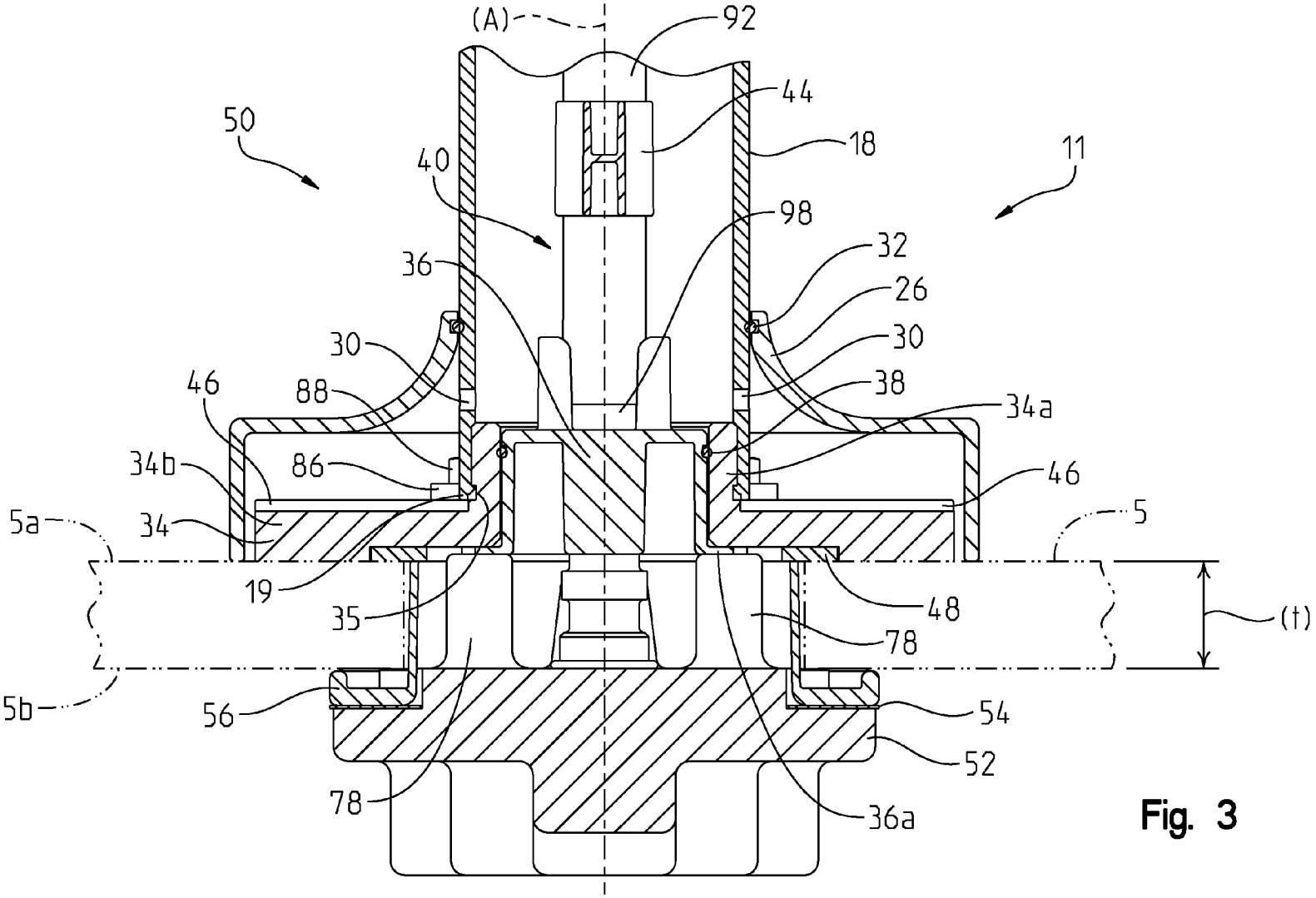
FIG. 3 is a cross-sectional view of a rough-in assembly and a mounting assembly of the tub filler assembly of FIG. 1, taken along line 3-3 of FIG. 1.

As shown in FIGS. 1 and 2, mounting assembly 11 includes a trim member 18 and an escutcheon 26 or other cover member. Trim member 18 is coupled to spout 12 and illustratively extends along a vertical axis (A) between floor 5 and a top surface of tub 1. As detailed further herein, trim member 18 may have a fixed length along axis (A) such that the position of trim member 18 and spout 12 is constant and independent of the thickness (t) of floor 5. Trim member 18 may be comprised of a metallic or polymeric material. As shown in FIG. 3, trim member 18 includes at least one opening 30 and feet 19 at a lower end thereof. Feet 19 are supported above finished floor surface 5*a* of floor 5. In the embodiment of FIG. 3, trim member 18 includes two opposing openings 30 for detecting water leaks within trim member 18, as detailed further herein. Trim member 18 is sealingly coupled to escutcheon 26 with sealing members 32, illustratively an o-ring.

Figure 9:
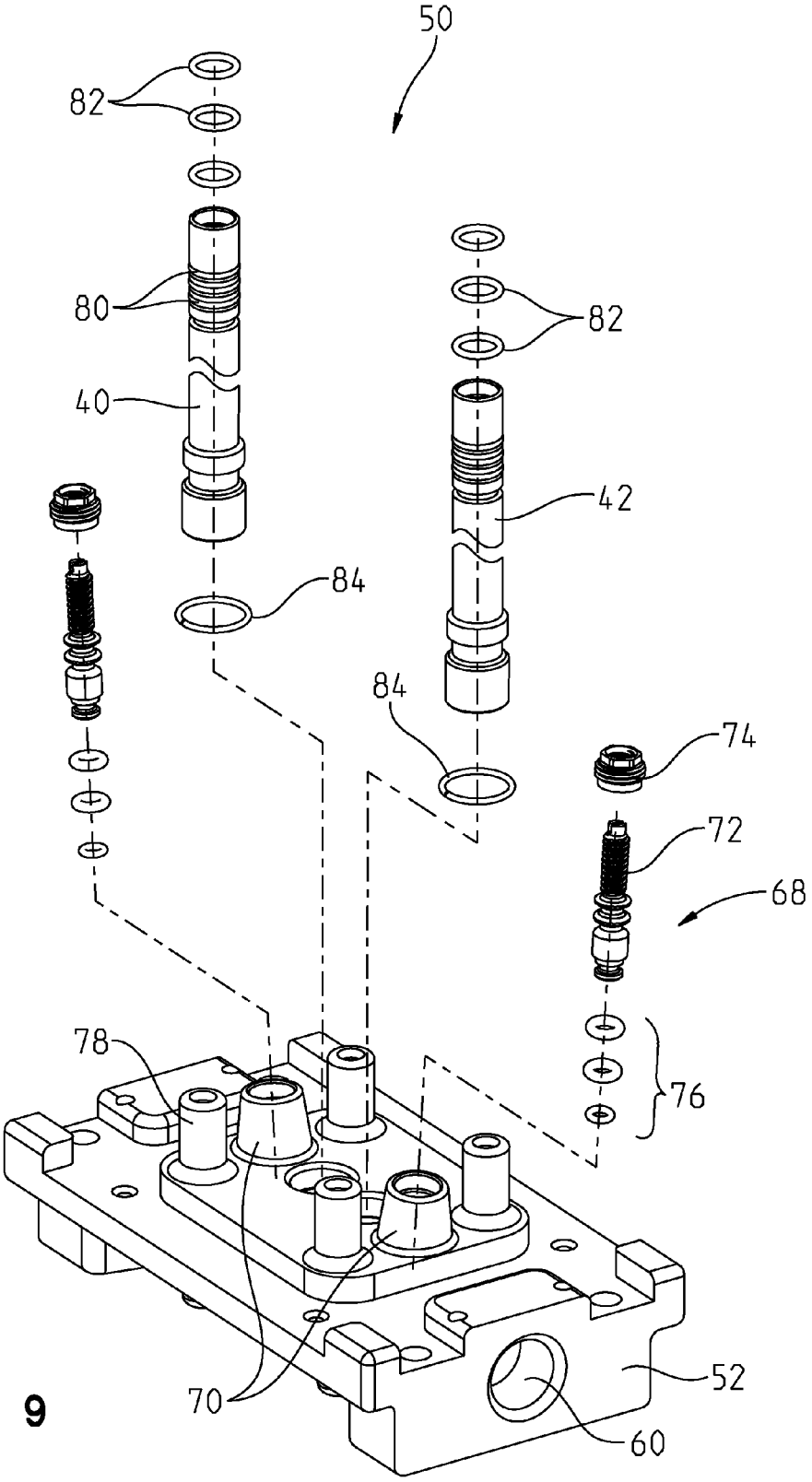
FIG. 9 is an exploded view of the rough-in assembly of FIG. 7.

In one embodiment, trim member 18 includes trim tubes 92, 94, as shown in FIG. 4. Trim tube 92 sealingly couples with hot water inlet tube 40 and trim tube 94 sealingly couples with cold water inlet tube 42. As shown in FIG. 9, an upper portion of inlet tubes 40, 42 includes a plurality of grooves 80 configured to receive sealing members, illustratively o-rings 82 and 84, for sealing against trim tubes 92, 94. Trim tubes 92, 94 extend upwardly from inlet tubes 40, 42 along axis (A) and are fluidly coupled to valve assembly 20 to deliver water from outlet 2 and/or sprayhead 16.

Referring to FIG. 3, mounting assembly 11 further includes a mounting plate 34, a first tube guide 36, a sealing member 38, and a second tube guide 44. Mounting plate 34 includes a planar portion 34*b* and an upstanding portion 34*a*. Planar portion 34*b* is coupled to a top surface of finished flooring surface 5*a* of floor 5. A sealing member 48 may be positioned therebetween. Planar portion 34*b* includes at least one channel 46 positioned below openings 30 of trim member 18, as detailed further herein. Illustratively, planar portion 34*b* includes two channels 46 corresponding to the two openings 30. Upstanding portion 34*a* extends upwardly within trim member 18 and may be coupled thereto with conventional fasteners. In one embodiment, upstanding portion 34*a* may include a channel or groove 35 for receiving feet 19 of trim member 18. As such, trim member 18 may be retained on mounting plate 34.

Referring to FIG. 4, first tube guide 36 of mounting assembly 11 is positioned within a central opening of mounting plate 34 and is sealingly coupled thereto with sealing member 38. Illustratively, sealing member 38 is an o-ring. In one embodiment, first tube guide 36 includes a flange 36*a* positioned intermediate finished flooring surface 5*a* of floor 5 and planar portion 34*b* of mounting plate 34. Additionally, first tube guide 36 may include shoulders 36*b* for further coupling first tube guide 36 to mounting plate 34. More particularly, shoulders 36*b* may be received within locating apertures 47 of mounting plate 34 in order to align first tube guide 36 with mounting plate 34.

Figure 10:
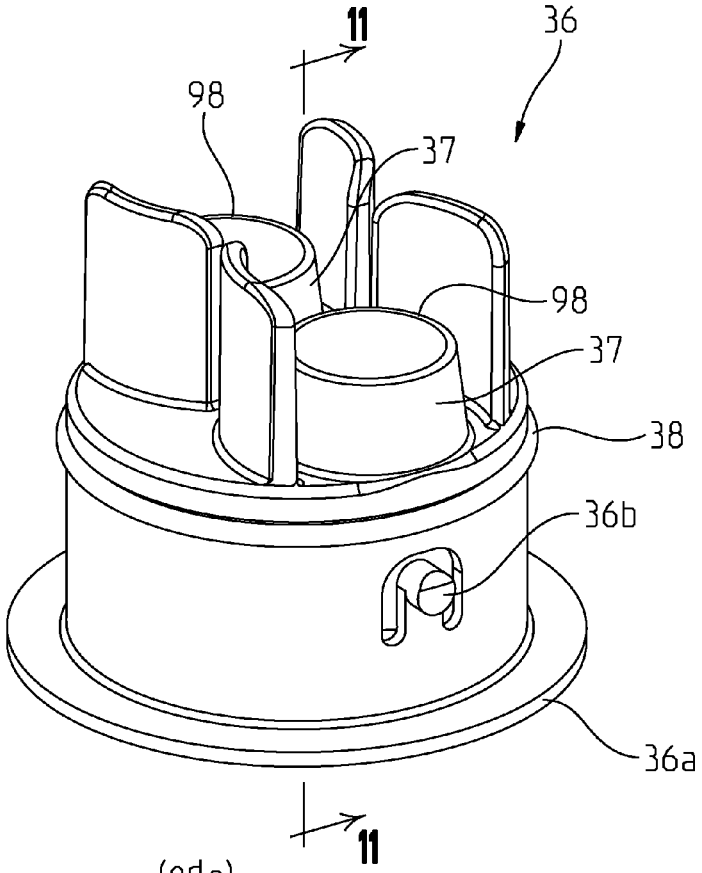
FIG. 10 is a front perspective view of a tube guide of the tub filler assembly of FIG. 4
Figure 11:
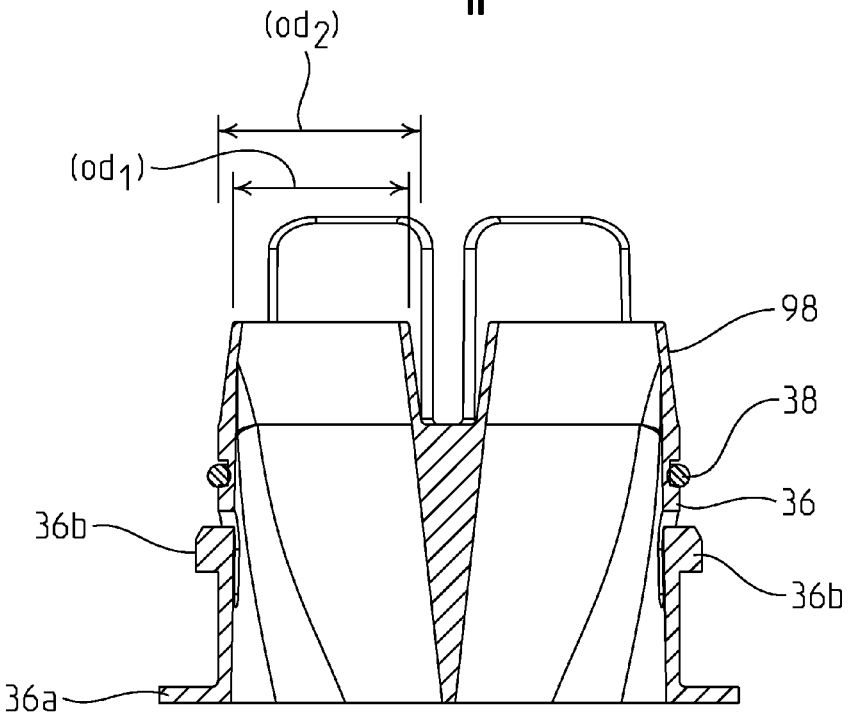
FIG. 11 is a cross-sectional view of the tube guide of FIG. 10, taken along line 11-11 of FIG. 10.

Referring to FIGS. 10 and 11, first tube guide 36 includes a pair of cylindrical sleeves 37 for receiving inlet tubes 40, 42 and trim tubes 92, 94. Illustratively, an upper portion 98 of sleeves 37 of first tube guide 36 is tapered such that an outer diameter ($od_1$) of upper portion 98 is less than an outer diameter ($od_2$) of the remainder of sleeves 37. A lower end 96 of trim tubes 92, 94 is received over the tapered upper portion 98 of sleeves 37. When lower end 96 of trim tubes 92, 94 overlaps upper portion 98 of sleeves 37, lower end 96 angles outwardly such that the inner diameter of trim tubes 92, 94 increases at lower end 96. As such, first tube guide 36 facilitates the coupling between trim tubes 92, 94 and inlet tubes 40, 42, respectively, as further detailed herein.

Second tube guide 44 is spaced apart from first tube guide 36, as shown in FIGS. 3 and 4. Second tube guide 44 includes an opening for trim tube 92 and an opening for trim tube 94. Second tube guide 44 generally surrounds trim tubes 92, 94 and may be coupled to trim member 18. Second tube guide 44 clips or is otherwise retained on trim tubes 92, 94 for alignment and stabilization of trim tubes 92, 94 within trim member 18.

Figure 5:
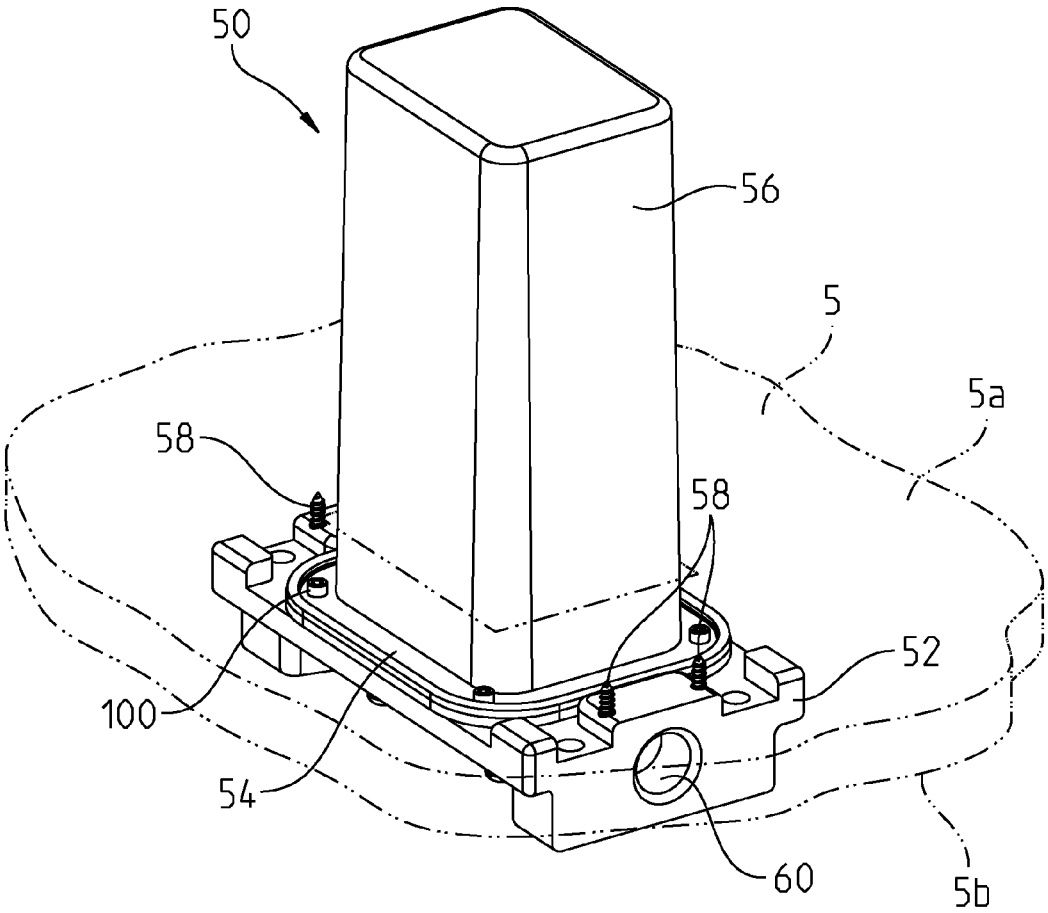
FIG. 5 is a front perspective view of the rough-in assembly of FIG. 4 coupled to a floor.
Figure 6:
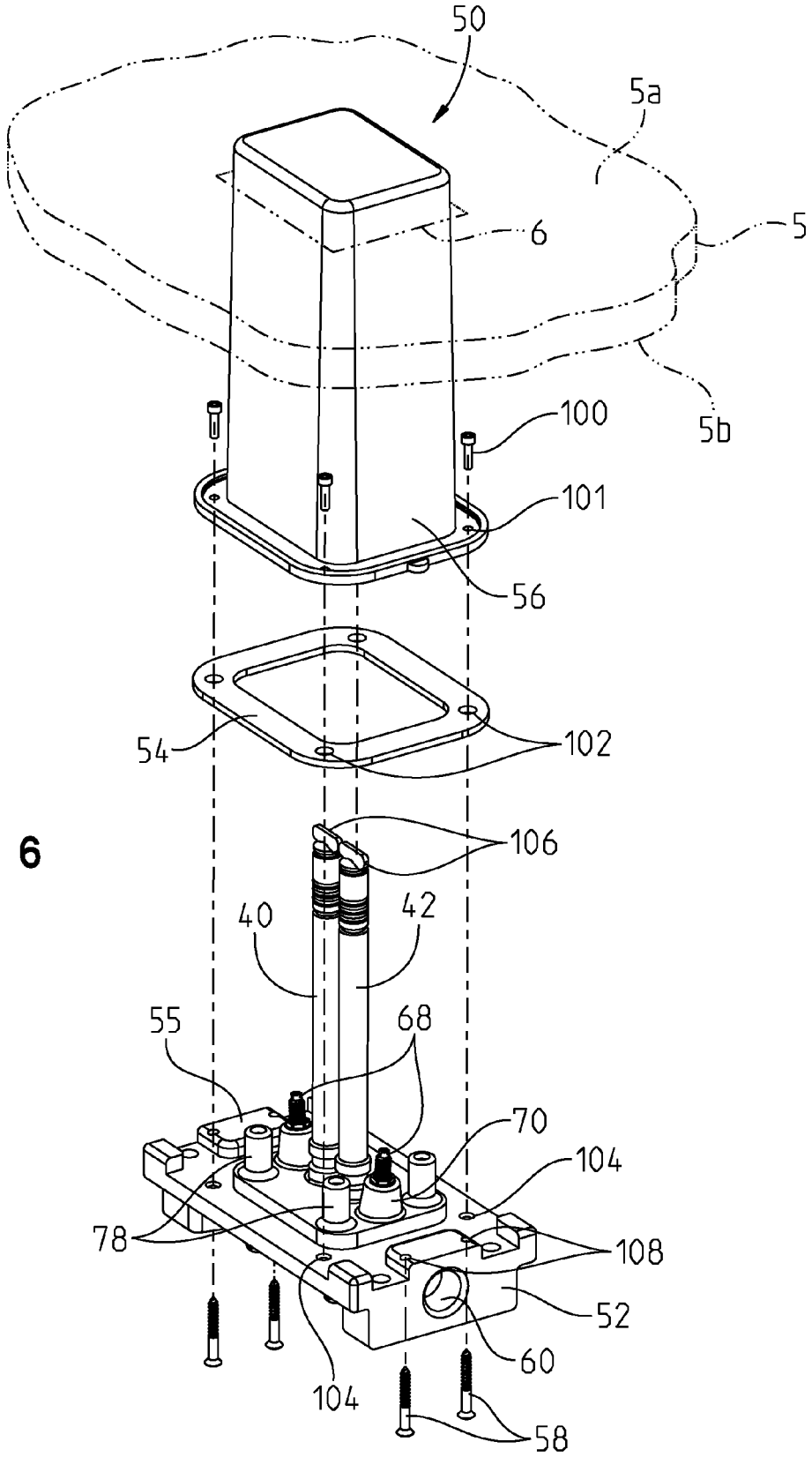
FIG. 6 is an exploded view of the rough-in assembly and the floor of FIG. 5.

Referring to FIGS. 5-9, rough-in assembly 50 includes inlet tubes 40 and 42, a base 52, and a sealing member 54. In one embodiment, rough-in assembly 50 further includes a cover 56. Cover 56 conceals inlet tubes 40, 42 and a portion of base 52, and may be sealingly coupled to base 52 with sealing member 54. Illustratively, and referring to FIG. 6, fasteners 100 may be received through apertures 101 in cover 56, apertures 102 in sealing member 54, and apertures 104 in base 52 in order to couple cover 56 and sealing member 54 to base 52. As shown in FIGS. 3, 4, and 6, sealing member 54 may be positioned intermediate base 52 and cover 56.

As shown in FIGS. 3-5, at least a portion of rough-in assembly 50 is positioned below floor 5 and, illustratively, may be coupled to subfloor structure 5*b* or other supporting structure below finished flooring surface 5*a* of floor 5. For example, if finished flooring surface of floor 5 is a tile floor, rough-in assembly 50 is coupled below the tile and is coupled to subfloor structure 5*b*. Other portions of rough-in assembly 50 extend above floor 5 into the living space so as to be accessible from the living space (i.e., the space above floor 5). Rough-in assembly 50 is configured to accommodate varying thicknesses (t) of floor 5 because rough-in assembly 50 is coupled below floor 5, illustratively below subfloor structure 5*b* of floor 5. In particular, the thickness (t) of floor 5 may vary depending on the surface. For example, tile may have a greater thickness than carpet. However, with rough-in assembly 50 positioned below floor 5, the thickness (t) of floor 5 does not affect the height of tub filler assembly 10. More particularly, the height of spout 12 remains constant relative to tub 1, regardless of the parameters of floor 5. Additional features of tub filler assembly 10 also allow the height of spout 12 to remain constant relative to tub 1 and are detailed further herein.

Figure 7:
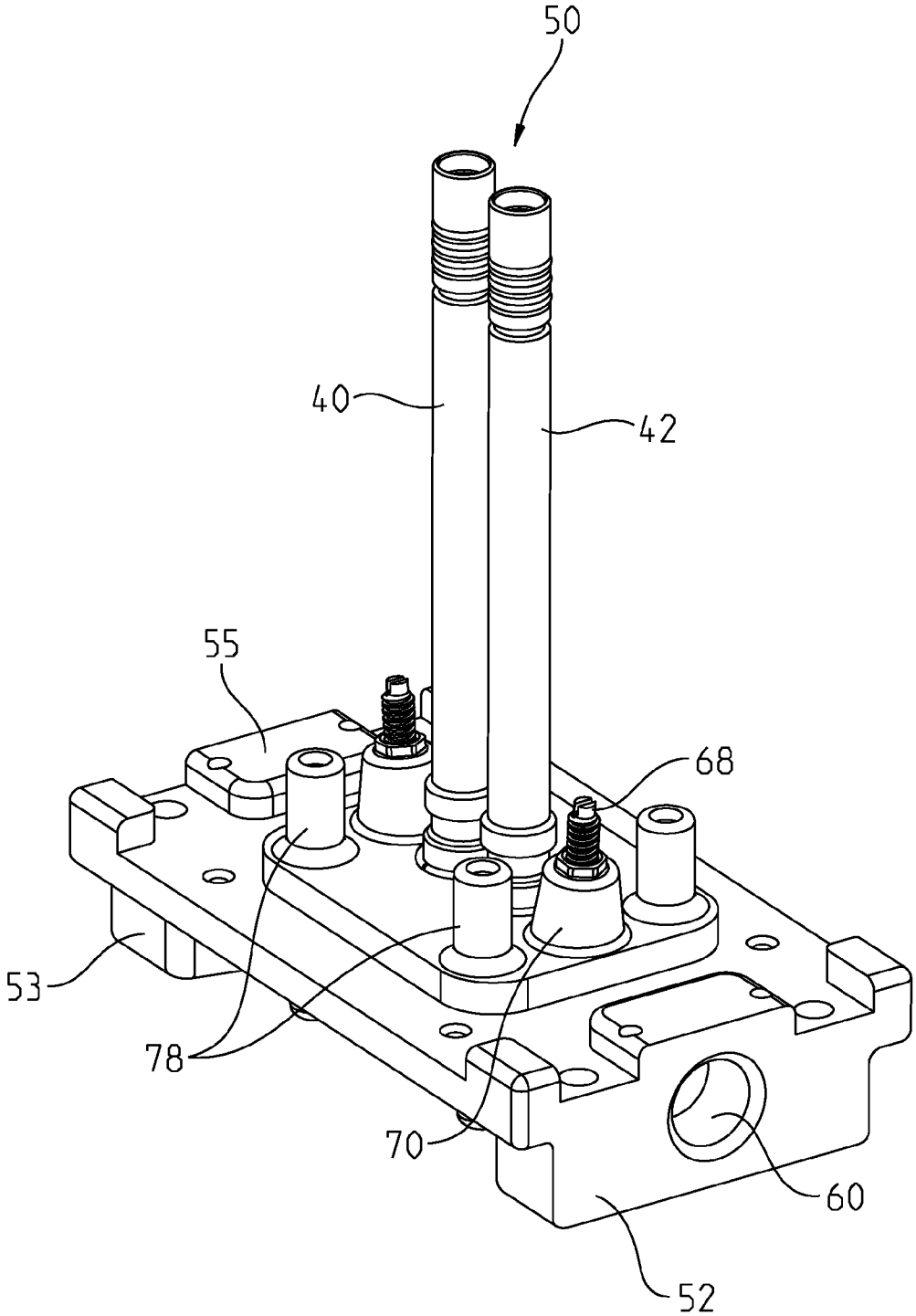
FIG. 7 is a front perspective view of a portion of the rough-in assembly of FIG. 6.
Figure 8:
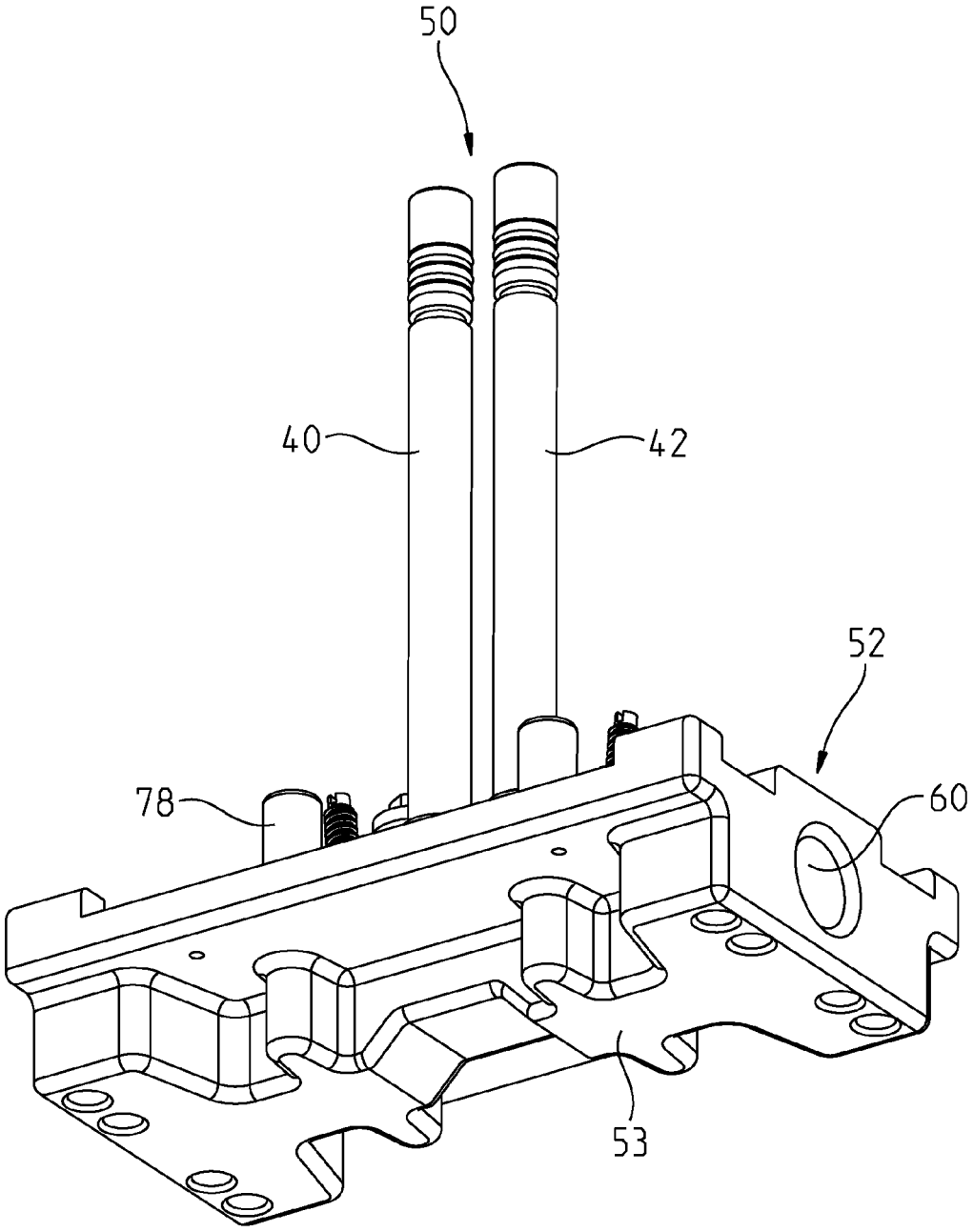
FIG. 8 is a bottom perspective view of the rough-in assembly of FIG. 7.

Illustratively, base 52 is coupled to subfloor structure 5*b* of floor 5 with fasteners 58. Referring to FIGS. 6-8, base 52 includes a top surface 55 and a bottom surface 53. Top surface 55 and bottom surface 53 are contoured to accommodate various components of base 52. In one embodiment, base 52 may be coupled below subfloor structure 5*b* of floor 5. In another embodiment, base 52 may be coupled to a top surface of subfloor structure 5*b* and below finished flooring surface 5*a* (e.g., tile) of floor 5. In a further embodiment, base 52 may be supported within other structures of floor 5 and below the top surface of finished flooring structure 5*a*. In any embodiment of rough-in assembly 50, base 52 is positioned below finished flooring surface 5*a* of floor 5 such that base 52 is not accessible or visible from the living space.

As shown in FIGS. 4 and 5, base 52 includes a water supply port 60 for fluidly coupling hot water inlet tube 40 to the hot water supply through a waterway 64. Additionally, base 52 includes a water supply port 62 for fluidly coupling cold water inlet tube 42 to the cold water supply through a waterway 66. Stop valves 68 may be coupled to base 52 and are configured to open and close waterways 64, 66. Illustratively, as shown in FIG. 9, stop valves 68 includes a threaded body 72, a coupler 74, and a plurality of sealing members 76. As shown in FIGS. 4 and 7, stop valves 68 may be coupled to bosses 70 of base 52. In particular, bosses 70 may include internal threads to threadedly couple with stop valves 68. In use, stop valves 68 may be rotated downwardly into bosses 70 to prevent water in waterways 64, 66 from entering inlet tubes 40, 42. Conversely, stop valves 68 may be rotated upwardly from bosses 70 to allow water in waterways 64, 66 to enter inlet tubes 40, 42. As shown in FIG. 4, threaded body 72 of stop valve 68 may extend above floor 5 and into the living space. Illustratively, threaded body 72 extends through an opening 90 of mounting plate 34 and are accessible to a user within the living space. Additionally, in one embodiment, inlet tubes 40, 42 each include a plug or cap 106 for testing and/or determining the pressure or other parameters of the water entering rough-in assembly 50. Caps 106 are removed when inlet tubes 40, 42 are coupled to trim tubes 92, 94.

Base 52 also includes cylindrical openings 78 for coupling base 52 with mounting plate 34. As shown in FIGS. 3, 4, and 6, cylindrical openings 78 extend upwardly from top surface 55 of base 52 and are configured to receive fasteners 86 and 88 (FIGS. 3 and 4). In one embodiment, fastener 86 is a washer or spacer positioned atop planar portion 34*b* of mounting plate 34. Fastener 88 may be a bolt, screw, or other coupler. Illustratively, fastener 88 is threadedly coupled to cylindrical opening 78 to secure mounting plate 34 to base 52. The length of fasteners 88 and the size of cylindrical openings 78 is configured to accommodate varying thicknesses (t) of floor 5, such that fasteners 88 may be coupled to cylindrical openings 78 regardless of the thickness (t) of floor 5.

During installation of tub filler assembly 10, rough-in assembly 50 is provided below floor 5. Alternatively, rough-in assembly 50 may be installed when the plumbing system is installed. Initially, rough-in assembly 50 may include cover 56. As such, cover 56 is coupled to sealing member 54 and base 52 with fasteners 100. With cover 56 coupled to base 52, other components of rough-in assembly 50, such as inlet tubes 40, 42 and bosses 70 and cylindrical openings 78 of base 52 may be protected from dirt, debris, contamination, and damage during installation of tub filler assembly 11. Rough-in assembly 50 is coupled to subfloor structure 5*b* of floor 5 with fasteners 58. Fasteners 58 extend through apertures 108 (FIG. 6) in base 52 and into a lower portion of floor 5 (e.g., subfloor structure 5*b* of floor 5). As shown in FIGS. 5 and 6, when base 52 is coupled to floor 5, base 52 is positioned below floor 5 and a portion of rough-in assembly 50, including a portion of cover 56, extend through an opening 6 in floor 5 and into the living space. Cover 56 conceals bosses 70, cylindrical openings 78, and inlet tubes 40, 42 until mounting assembly 11 is coupled to rough-in assembly 50. As such, cover 56 protects rough-in assembly 50 from contamination and damage before installation of mounting assembly 11.

When base 52 is coupled to floor 5, water supply tubes (not shown) may be fluidly coupled thereto. In particular, a hot water supply may be sealingly coupled to water supply port 60 and a cold water supply may be sealingly coupled to water supply port 62 of base 52. As shown in FIG. 4, waterways 64, 66 are positioned below floor 5. Initially, stop valves 68 may be in a downward position such that waterways 64, 66 are closed. Before mounting assembly 11 is coupled to rough-in assembly 50, caps 106 in inlet tubes 40, 42 may be used to test and/or determine the pressure or other parameters of the water in waterways 64, 66 and inlet tubes 40, 42.

To couple mounting assembly 11 to rough-in assembly 50, the upper portion of cover 56 (i.e., the portion of cover 56 extending above finished flooring surface 5*a* of floor 5) is removed. For example, the upper portion of cover 56 may be cut away from the lower portion of cover. When the upper portion of cover 56 has been removed, sealing member 48 may be positioned around opening 6 of floor 5 and above the top surface thereof.

Additionally, with the upper portion of cover 56 removed, first tube guide 36 may be positioned over inlet tubes 40, 42. Prior to assembling first tube guide 36 with inlet tubes 40, 42, first tube guide 36 may be coupled with trim tubes 92, 94 such that lower end 96 of trim tubes 92, 94 overlap upper portion 98 of sleeves 37 of first tube guide 36. The length of the overlap between trim tubes 92, 94 and inlet tubes 40, 42 may be adjusted to allow the position or height of mounting assembly 11 to remain constant relative to tub 1, regardless of the thickness (t) of floor 5. Additionally, the overlap between sleeves 37 and trim tubes 92, 94 forms a generally smooth or flat inner surface and increases the inner diameter of lower ends 96 of trim tubes 92, 94. As such, the entire assembly of first tube guide 36 and trim tubes 92, 94 may be received over inlet tubes 40, 42 in order to form a continuous passage from waterways 64, 66 to valve assembly 20. Second tube guide 44 may be coupled to trim tubes 92, 04 for stabilization and alignment during assembly with first tube guide 36 and/or inlet tubes 40, 42.

By assembling trim tubes 92, 94 with first tube guide 36 before installing first tube guide 36 onto inlet tubes 40, 42, interference with o-rings 82 on inlet tubes 40, 42 may be avoided. More particularly, the smooth inner surface formed at the overlap between lower ends 96 of trim tubes 92, 94 and upper portion 98 of sleeves 37 provides a gradual and smooth transition surface over o-rings 82. As such, a complete seal may be formed between inlet tubes 40, 42 and trim tubes 92, 94 because the blunt bottom surface of lower end 96 of trim tubes 92, 94 does not interfere with and/or dislodge o-rings 82.

As shown in FIGS. 3 and 4, after first tube guide 36 and trim tubes 92, 94 are coupled to inlet tubes 40, 42, mounting plate 34 may be positioned above sealing member 48 and floor 5. Mounting plate is received over first tube guide 36 and trim tubes 92, 94 and sealingly engaged first tube guide 36 through sealing member 38. Mounting plate 34 is aligned with stop valves 68 such that threaded bodies 72 of stop valves 68 extend through openings 90 of mounting plate. As such, at least an upper end of threaded bodies 72 extends into the living space and is accessible by a user from above floor 5. Mounting plate 34 is coupled to base 52 and floor 5 with fasteners 86, 88. In one embodiment, fasteners 88 are threadedly coupled to cylindrical openings 78 of base 52 and fasteners 86 are positioned intermediate fasteners 88 and planar portion 34*b* of mounting plate 34.

The length of fasteners 88 and cylindrical openings 78 may be configured to accommodate various thicknesses (t) of floor 5. For example, if floor 5 includes tile, the thickness (t) of floor 5 may be greater than that of a carpeted floor. The length of fasteners 88 and cylindrical openings 78 is configured to accommodate various thicknesses (t) of floor 5 such that, regardless of the thickness (t) of floor 5, rough-in assembly 50 may be positioned below floor 5 and mounting assembly 11 may be positioned above floor 5. With mounting assembly 11 positioned above floor 5, the position of mounting assembly 11 remains constant relative to tub 1.

Trim member 18 may be received over trim tubes 92, 94 during installation of tub filler assembly 10. Alternatively, trim member 18 may be coupled to trim tubes 92, 94 and, as such, may be assembled with rough-in assembly 50 when trim tubes 92, 94 are coupled to inlet tubes 40, 42. In one embodiment, when trim member 18 is received over mounting plate 34, the position of trim member 18 may be adjusted along axis (A) such that trim member 18 axially "floats" along axis (A), thereby allowing the height of trim member 18 to remain constant relative to tub 1, irrespective of the thickness (t) of floor 5.

Trim member 18 and mounting plate 34 are aligned such that openings 30 of trim member 18 align with channels 46 of mounting plate 34. As such, if a leak occurs within trim member 18, water flows downwardly and may exit trim member 18 through openings 30. The water from openings 30 may flow into channels 46 and onto floor 5 as an early detection to users that an internal leak within tub filler assembly 11 has occurred. Sealing member 38 also assists in isolating rough-in assembly 50 and the space below floor 5 from any leak within trim member 18.

With trim member 18 installed, escutcheon 23 may be coupled thereto and sealed with sealing member 32. Spout 12 and valve assembly 20 also may be coupled to trim member 18.

It may be appreciate that because rough-in assembly 50 is positioned below floor 5 and mounting assembly 11 is positioned above floor 5, the vertical length of mounting assembly 11 above floor 5 is constant, regardless of the thickness (t) of floor 5. Additionally, because the length of the overlap between inlet tubes 40, 42 and trim tubes 92, 94 is adjustable and the vertical position of trim member 18 is similarly adjustable, the height of spout 12, relative to tub 1, is constant, regardless of the thickness (t) of floor 5. As such, the coupling of rough-in assembly 50 to mounting assembly 11 accommodates various thicknesses (t) of floor 5, which allows mounting assembly 11 and spout 12 to remain at a constant vertical height relative to tub 1.

Figure 12:
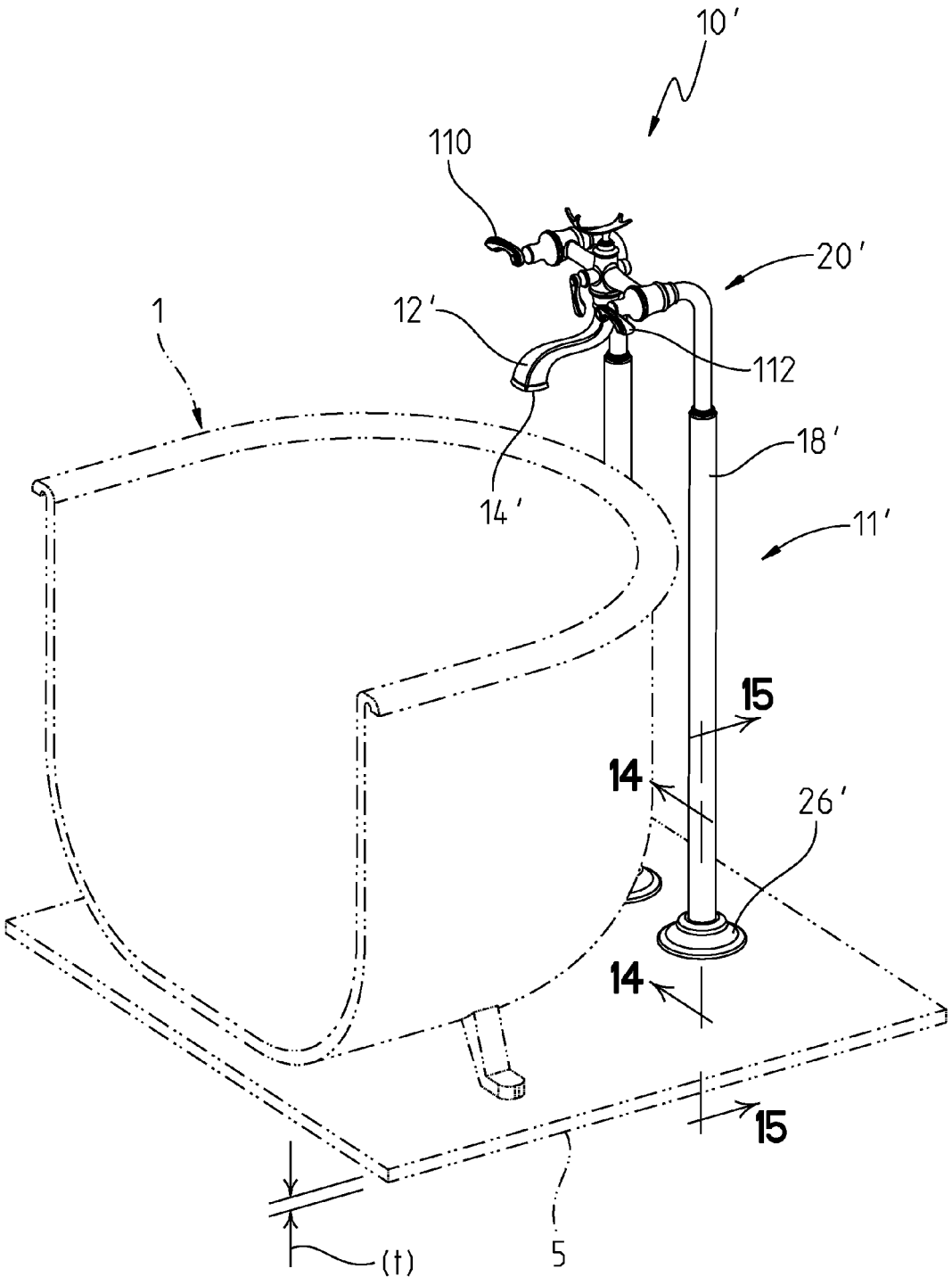
FIG. 12 is front perspective view of an illustrative alternative embodiment two-handle tub filler of the present disclosure, the alternative embodiment tub filler is positioned adjacent the tub.
Figure 13:
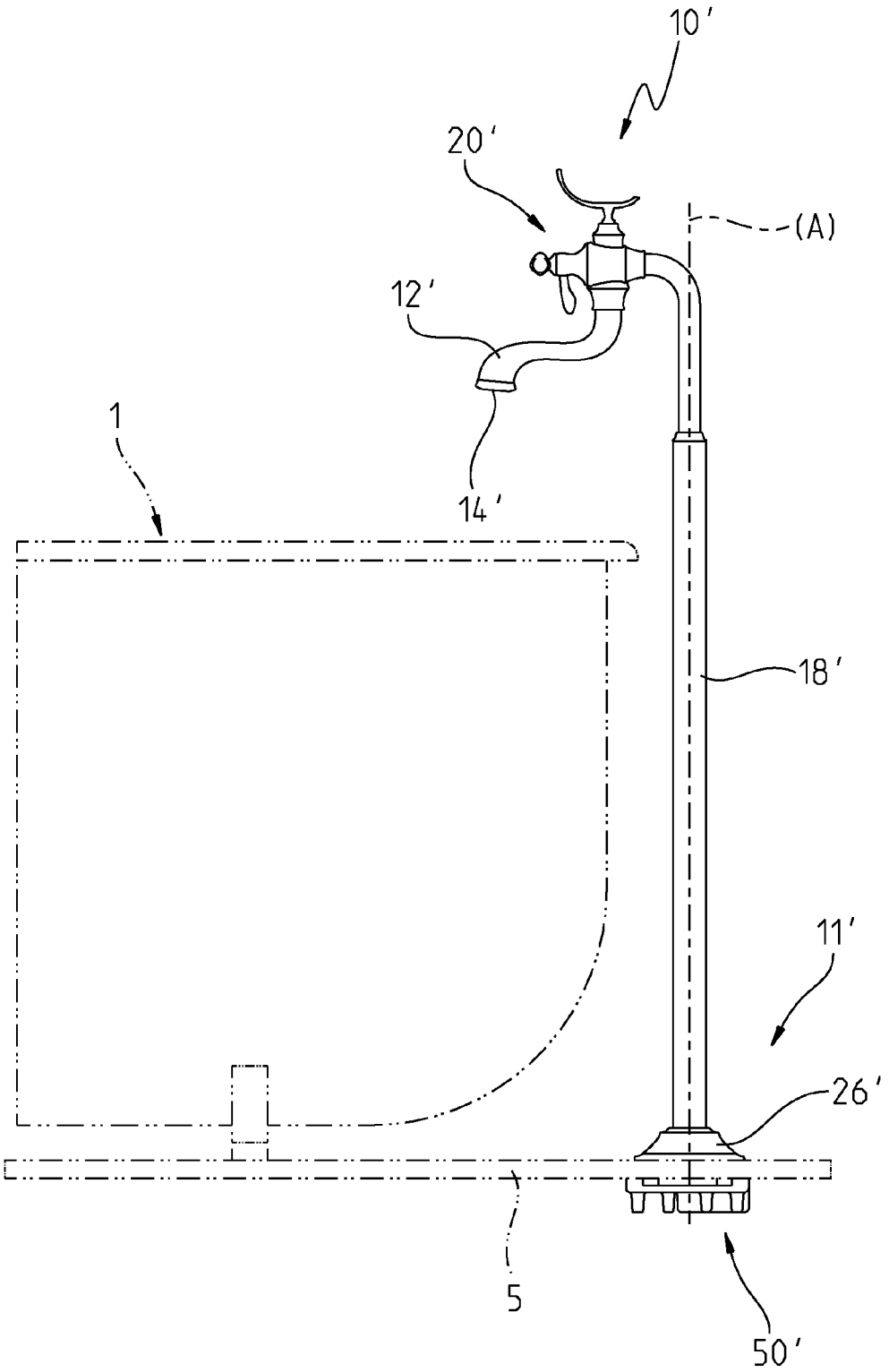
FIG. 13 is a side view of the alternative embodiment tub filler assembly and tub of FIG. 10.

Referring to FIGS. 12-20, an alternative embodiment tub filler assembly 10' is illustrated. Tub filler assembly 10' of FIGS. 10-18 includes features similar to those of tub filler assembly 10 of FIGS. 1-9, with like reference numerals indicating like elements, except as described below. Referring to FIGS. 13 and 13, an illustrative two-handle tub filler assembly 10' is coupled to floor 5 for providing water to a tub 1. Illustrative tub filler assembly 10' is a free-standing assembly positioned along an edge of tub 1. Tub filler assembly 10' includes a mounting assembly 11', a spout 12' having an outlet 14', a valve assembly 20', and a rough-in assembly 50'.

Figure 16:
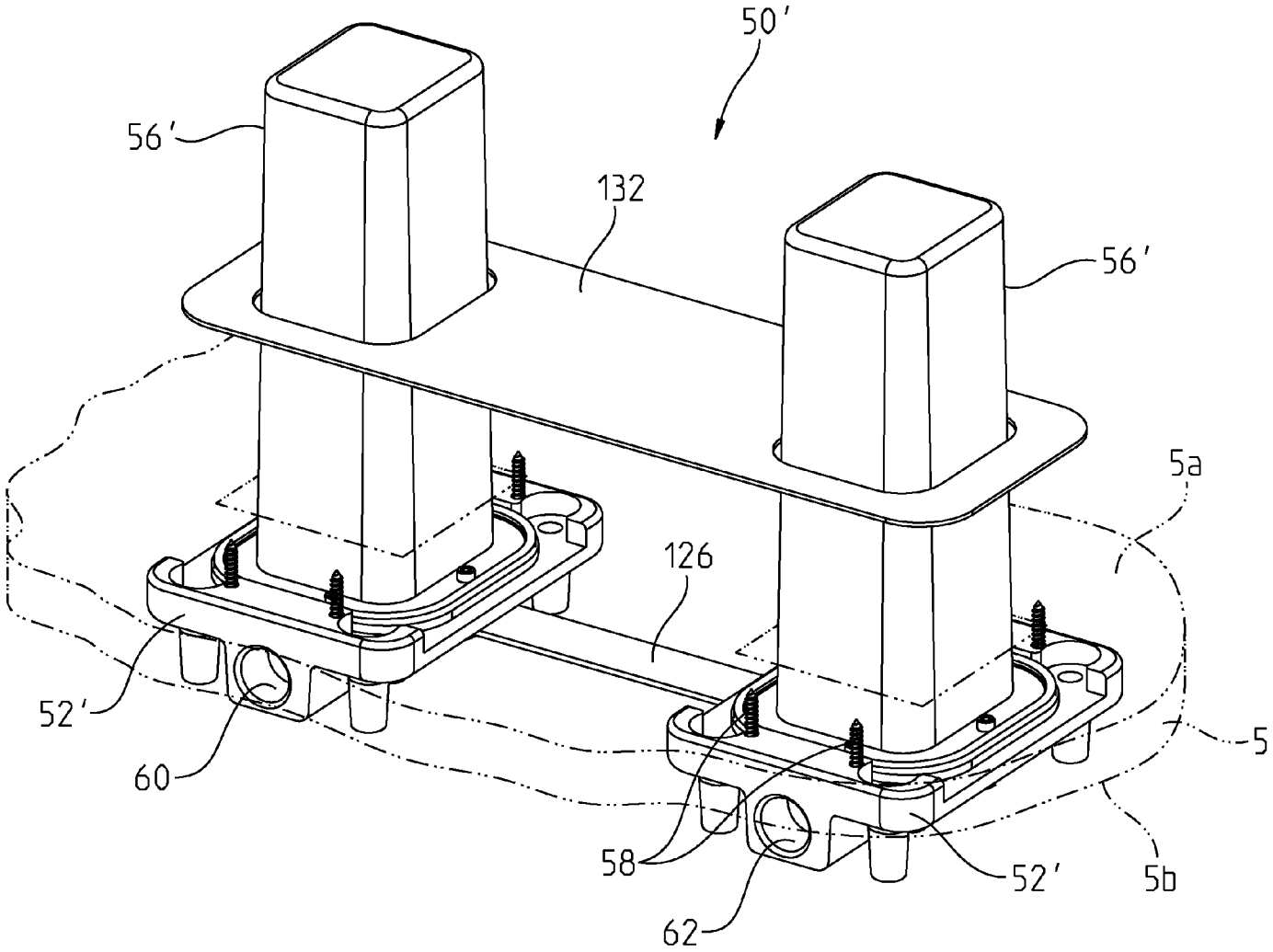
FIG. 16 is a front perspective view of the rough-in assembly of FIG. 15 coupled to the floor.

Valve assembly 20' includes a hot water handle 110, a cold water handle 112, and may include a diverter valve 24' for a showerhead or other sprayhead (not shown). Hot water handle 110 is fluidly coupled to hot water inlet tube 40' (FIG. 16) and cold water handle 112 is fluidly coupled to cold water inlet tube 42' (FIG. 16).

As shown in FIGS. 12 and 13, mounting assembly 11' includes trim members 18' and escutcheons 26'. Trim members 18' are coupled to spout 12' and each illustrative trim member 18' extends along a vertical axis (A) between floor 5 and a top surface of tub 1, as shown in FIG. 13. As detailed further herein, trim members 18' may have a fixed length along axis (A) such that the position of trim members 18' and spout 12' is constant and independent of the thickness (t) of floor 5. Trim members 18' are sealingly coupled to escutcheons 26' with sealing members 32, illustratively o-rings.

Figure 15:
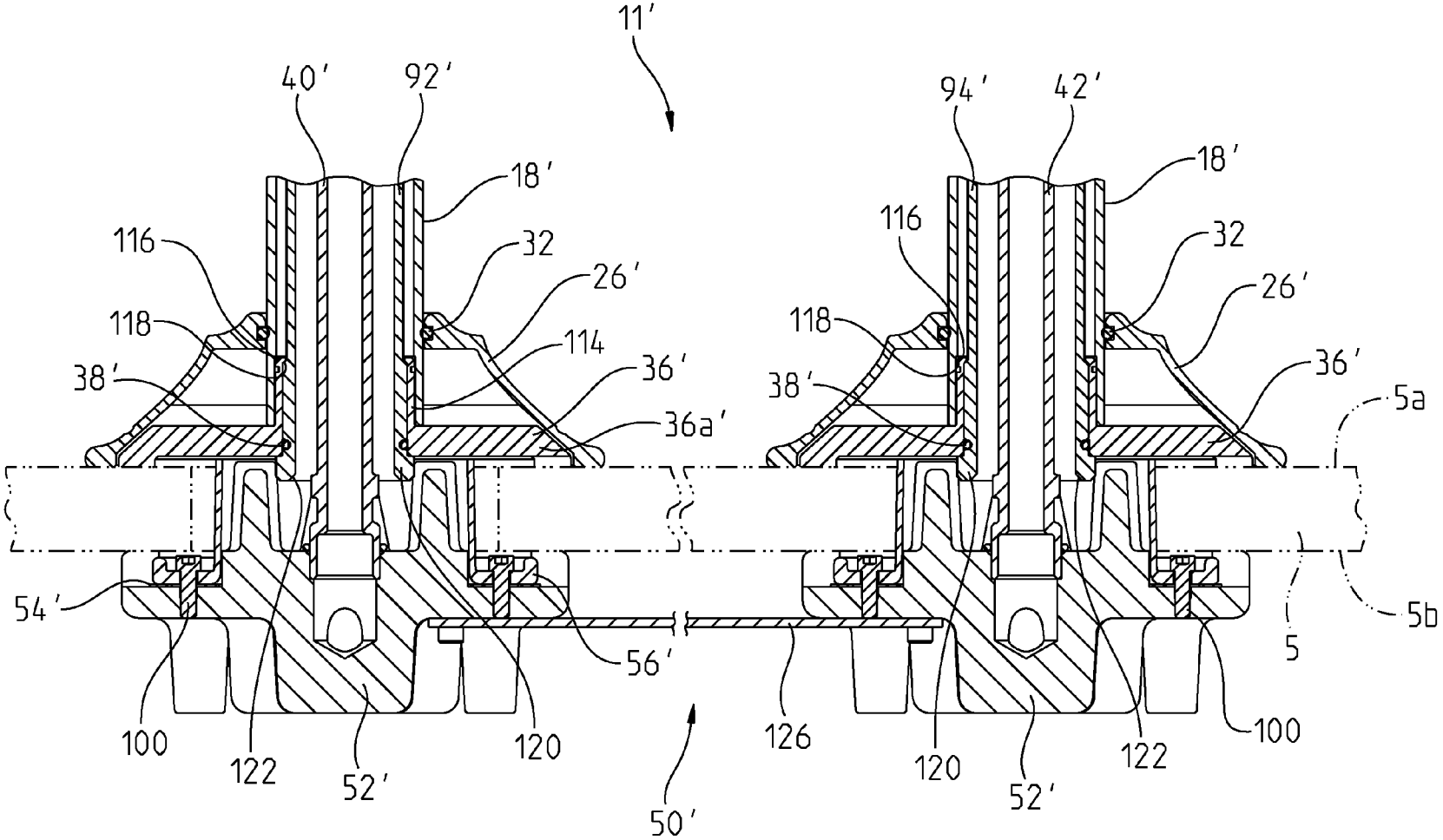
FIG. 15 is a further cross-sectional view of the rough-in assembly and the mounting assembly of the tub filler assembly of FIG. 12, taken along line 15-15 of FIG. 12.
Figure 20:
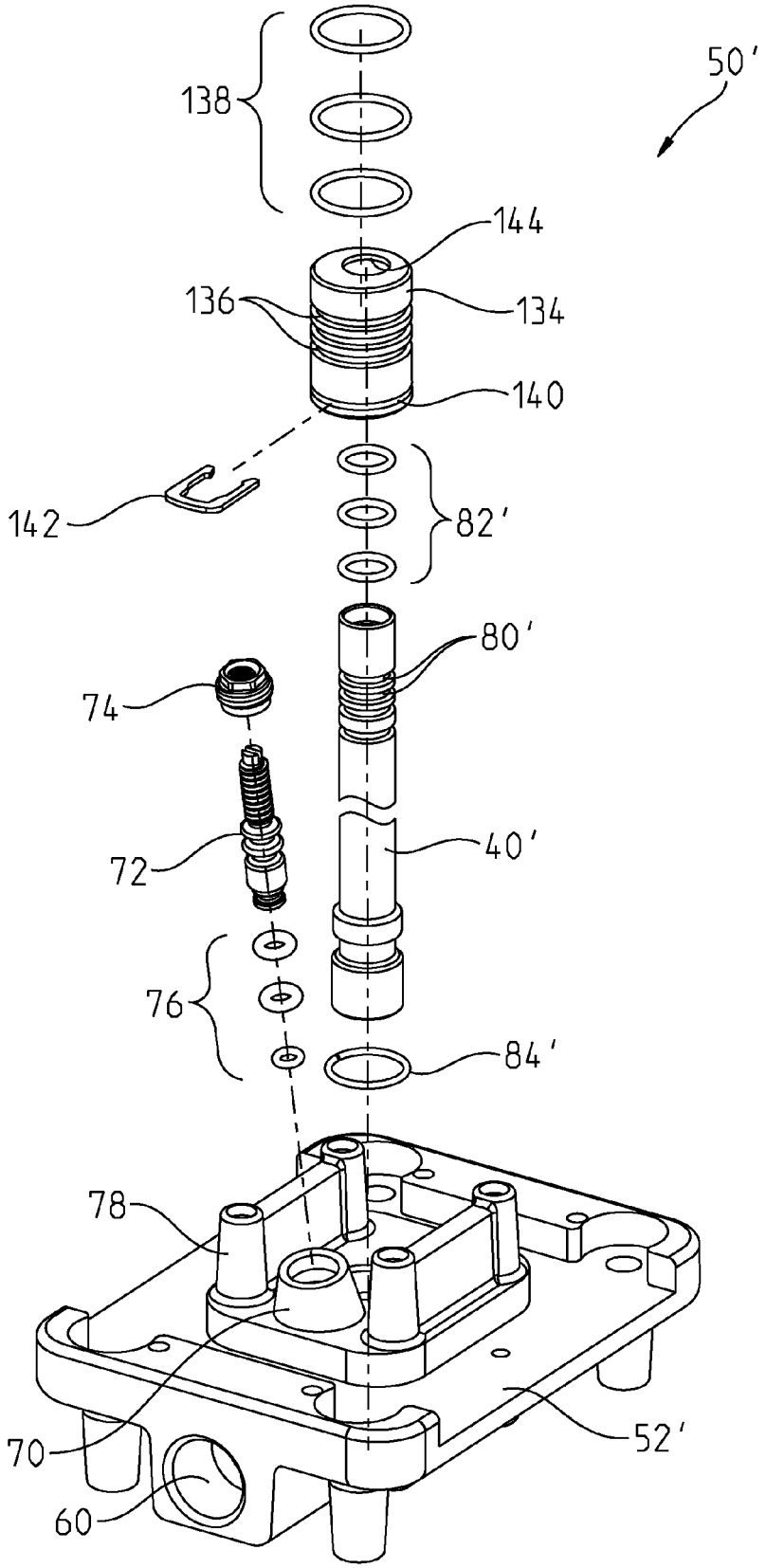
FIG. 20 is an exploded view of the rough-in assembly of FIG. 18.

In one embodiment, trim members 18' include trim tubes 92', 94', as shown in FIG. 15. Trim tube 92' sealingly couples with hot water inlet tube 40' and trim tube 94' sealingly couples with cold water inlet tube 42'. As shown in FIG. 20, an upper portion of inlet tubes 40', 42' includes a plurality of grooves 80' configured to receive sealing members, illustratively o-rings 82' and 84', for sealing against trim tubes 92', 94'. Trim tubes 92', 94' extend upwardly from inlet tubes 40', 42' along axis (A) (FIG. 13) and are fluidly coupled to valve assembly 20' to deliver water from outlet 2'.

Figure 14:
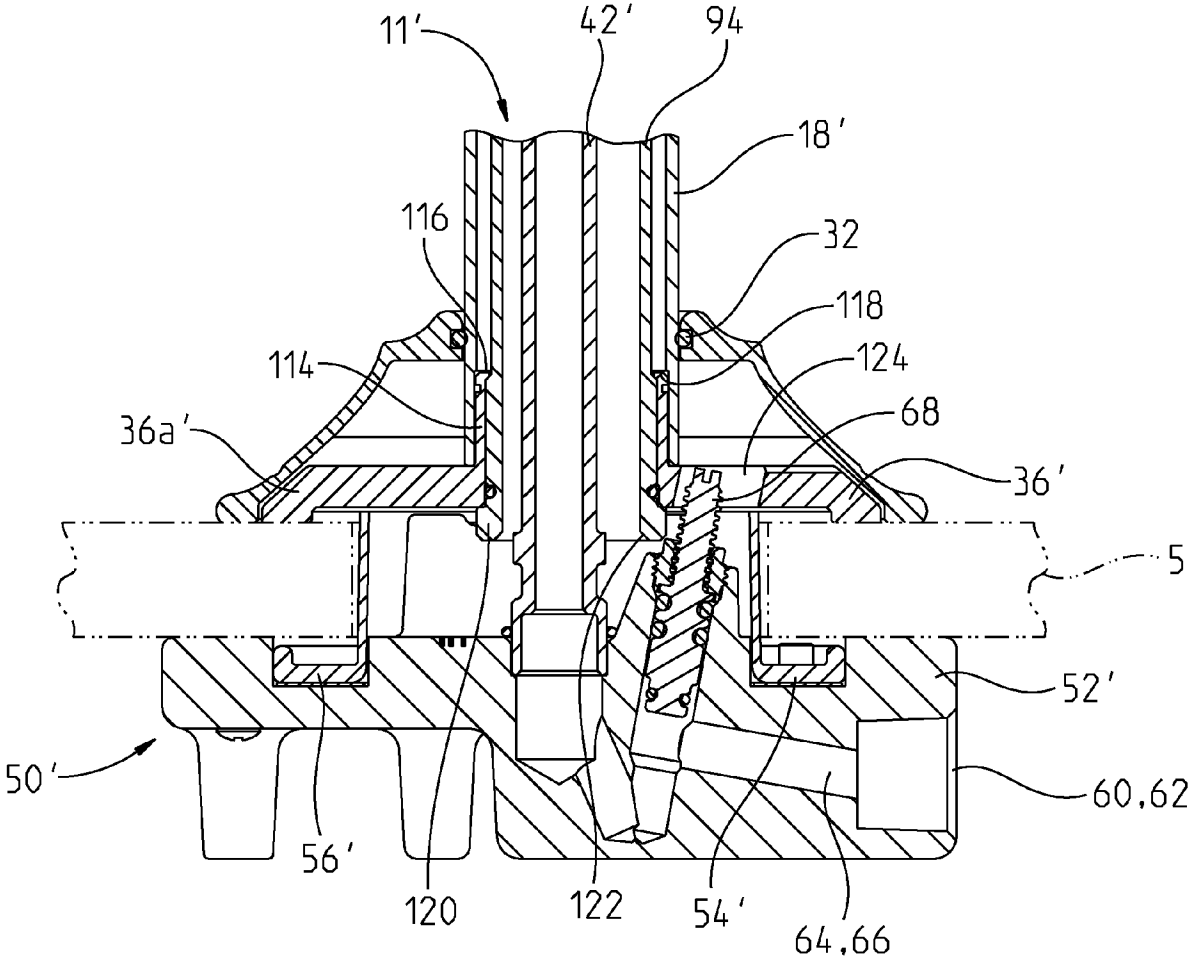
FIG. 14 is a cross-sectional view of a rough-in assembly and a mounting assembly of the tub filler assembly of FIG. 12, taken along line 14-14 of FIG. 12.

Referring to FIGS. 14 and 15, mounting assembly 11' further includes tube guides 36' and sealing members 38'. Tube guide 36' is sealingly coupled to trim tubes 92', 94' with sealing member 38'. Illustratively, sealing members 38' are o-rings. Trim tubes 92', 94' may include feet 120 that extend under tube guides 36' for coupling thereto. Feet 120 of trim tubes 92', 94' may have a tapered inner surface 122 for coupling with inlet tubes 40', 42', as detailed further herein.

In one embodiment, tube guides 36' include a flange 36*a*' positioned intermediate floor 5 and trim members 18'. Additionally, tube guides 36' may include upstanding portions 114 for coupling tube guides 36' to trim tubes 92', 94'. More particularly, upstanding portions 114 may include shoulders 116 that engage with shoulders 118 on trim tubes 92', 94' in order to align and couple tube guides 36' with trim tubes 92', 94'.

Figure 17:
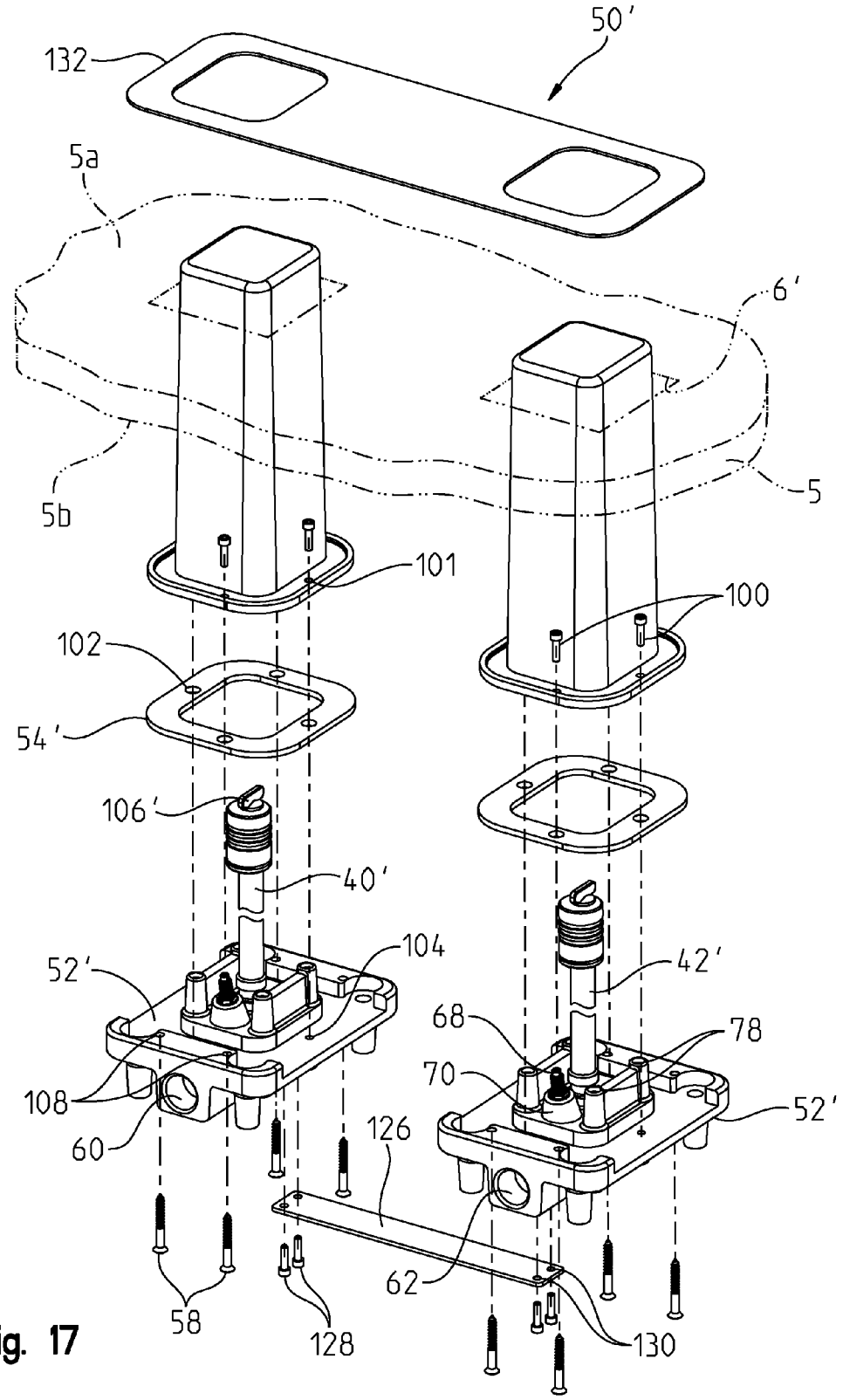
FIG. 17 is an exploded view of the rough-in assembly and the floor of FIG. 16.

Referring to FIGS. 16-20, rough-in assembly 50' includes inlet tubes 40' and 42', bases 52', and sealing members 54'. In one embodiment, rough-in assembly 50' further includes covers 56'. Covers 56' conceal inlet tubes 40', 42' and a portion of bases 52', and may be sealingly coupled to bases 52' with sealing members 54'. Illustratively, and referring to FIG. 17, fasteners 100 may be received through apertures 101 in covers 56', apertures 102 in sealing members 54', and apertures 104 in bases 52' in order to couple covers 56' and sealing members 54' to bases 52'. As shown in FIGS. 14, 15, and 17, sealing members 54' may be positioned intermediate bases 52' and covers 56'. In one embodiment, bases 52' also includes cylindrical openings 78 for coupling bases 52' to tube guides 36'.

As shown in FIGS. 15-17, at least a portion of rough-in assembly 50' is positioned below floor 5 and may be coupled to subfloor structure 5*b* or other supporting structure below floor 5. Other portions of rough-in assembly 50' extend above floor 5 into the living space so as to be accessible from the living space (i.e., the space above floor 5). As with rough-in assembly 50 of FIG. 5, rough-in assembly 50' is configured to accommodate varying thicknesses (t) of floor 5 because rough-in assembly 50' is coupled below floor 5. Additional features of tub filler assembly 10' also allow the height of spout 12' to remain constant relative to tub 1 and are detailed further herein. Illustratively, bases 52' are coupled below floor 5 with fasteners 58.

Figure 18:
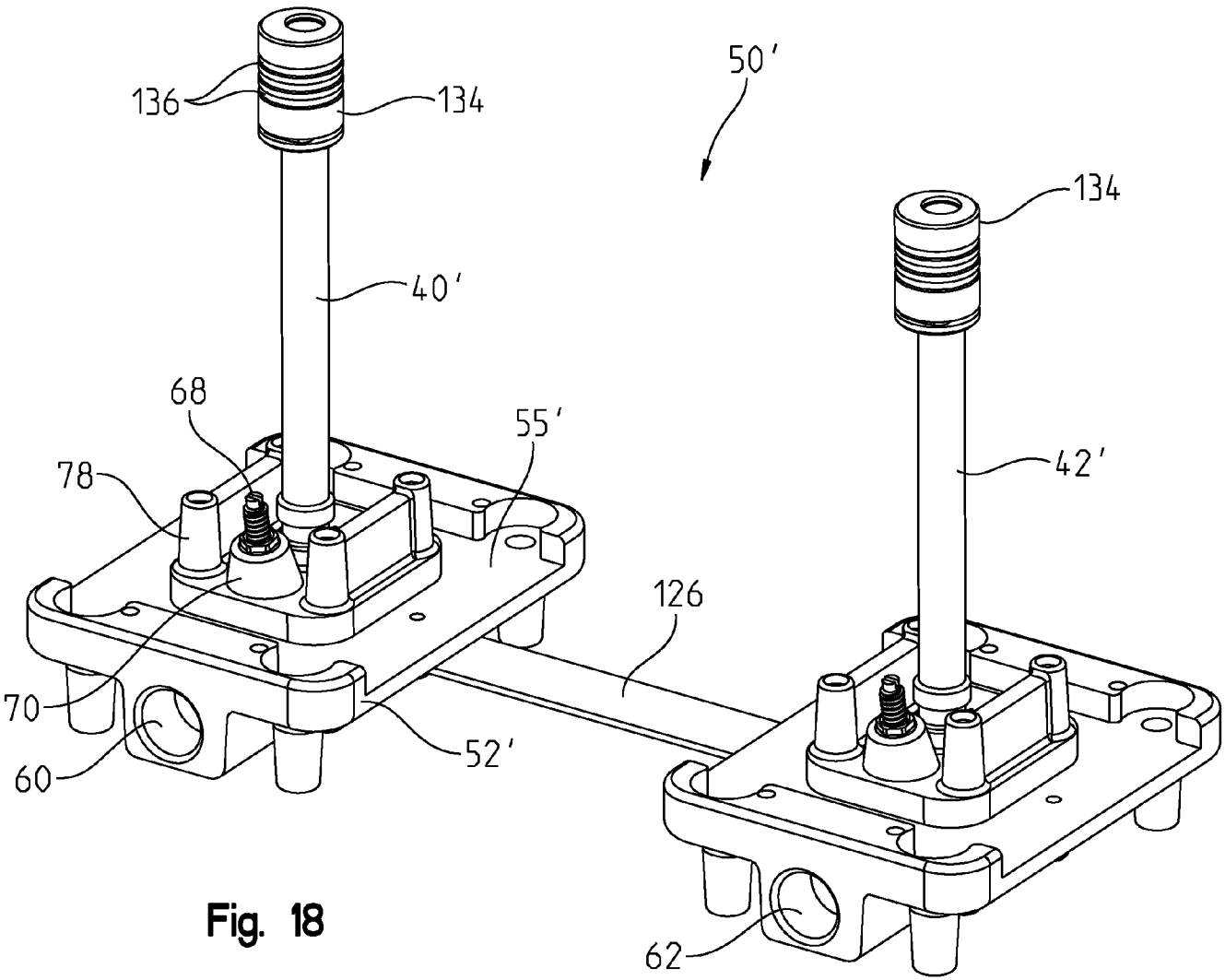
FIG. 18 is a front perspective view of a portion of the rough-in assembly of FIG. 17.
Figure 19:
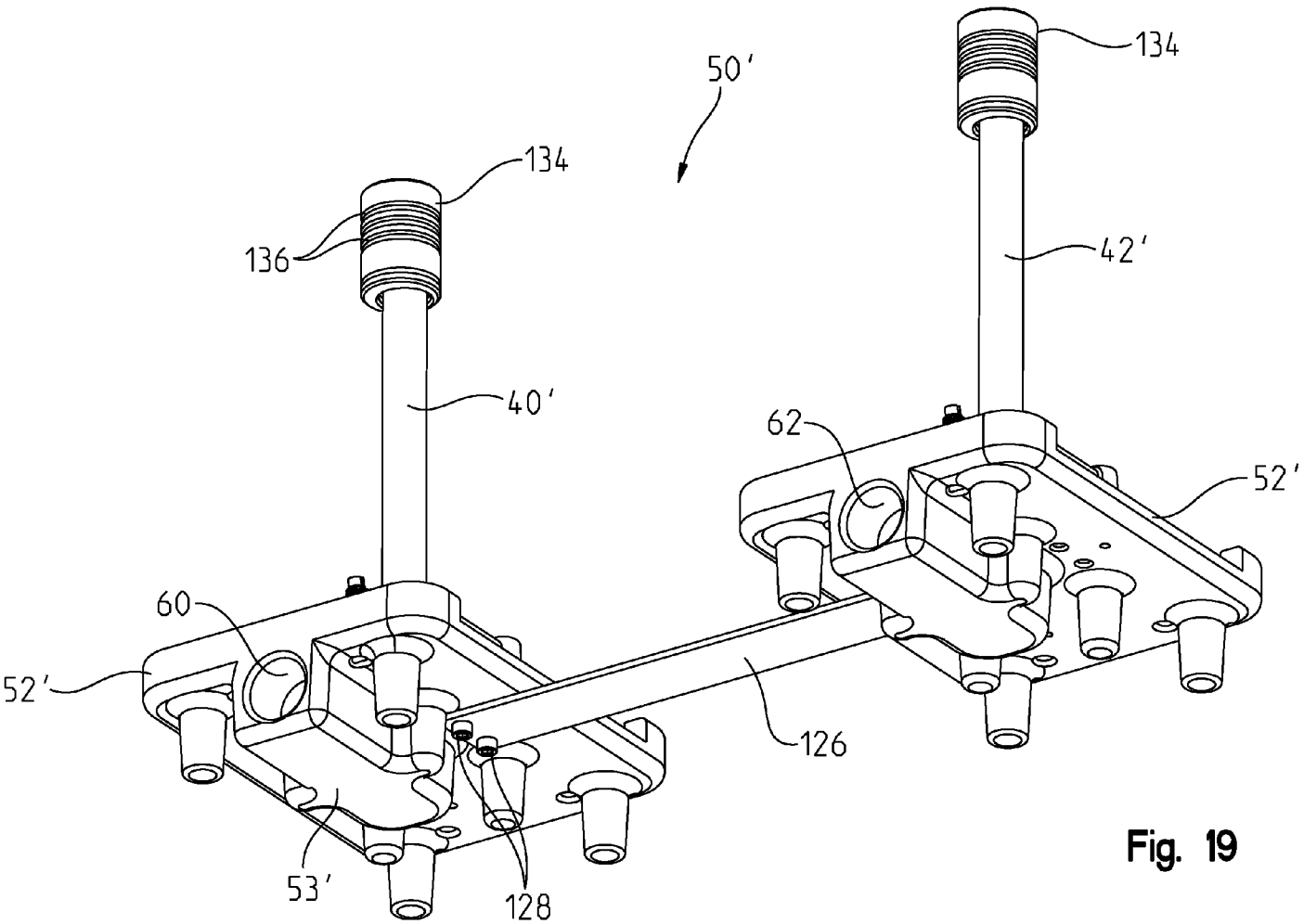
FIG. 19 is a bottom perspective view of the rough-in assembly of FIG. 18.

Referring to FIGS. 18 and 19, bases 52' include a top surface 55' and a bottom surface 53'. Top surfaces 55' and bottom surfaces 53' are contoured to accommodate various components of bases 52'. One base 52' includes a water supply port 60 for fluidly coupling hot water inlet tube 40' to the hot water supply through a waterway 64. Additionally, the other base 52' includes a water supply port 62 for fluidly coupling cold water inlet tube 42' to the cold water supply through a waterway 66. Stop valves 68 may be coupled to bases 52' and are configured to open and close waterways 64, 66. As shown in FIG. 20, stop valves 68 may be coupled to bosses 70 of bases 52'. As shown in FIG. 14, threaded body 72 of stop valve 68 may extend above floor 5 and into the living space. Illustratively, threaded body 72 extends through an opening 124 of tube guides 36' and are accessible to a user within the living space. Additionally, in one embodiment, inlet tubes 40', 42' each include cap 106' (FIG. 17) for testing and/or determining the pressure or other parameters of the water entering rough-in assembly 50'. Caps 106' are removed when inlet tubes 40', 42' are coupled to trim tubes 92', 94'.

Referring to FIGS. 16-19, bases 52' may be coupled together with a first alignment plate 126. First alignment plate 126 is coupled to bottom surface 53' of bases 52' with fasteners 128. Fasteners 128 extend through apertures 130 (FIG. 17) in first alignment plate 126. Additionally, as shown in FIGS. 16 and 17, rough-in assembly 50' may include a second alignment plate 132 which couples covers 56' together. First and second alignment plates 126 and 132 maintain a predetermined distance between bases 52'.

In one embodiment, as shown in FIGS. 18-20, rough-in assembly 50' includes adapters 134 for coupling trim tubes 92', 94' to inlet tubes 40', 42', as detailed further herein. Adapters 134 are coupled to an upper portion of inlet tubes 40', 42' with a retaining member, illustratively a clip 142. Clip 142 is received within a lower groove 140 of adapters 134. Adapters 134 also may engage o-rings 82', 84' when coupled to inlet tubes 40', 42'. Additionally, adapters 134 include a plurality of grooves 136. Grooves 136 receive a plurality of sealing members, illustratively o-rings 138, for sealingly coupling with trim tubes 92', 94'. A top surface of adapters 134 includes an opening 144 which receives caps 106'. As such, caps 106' may be removed from inlet tubes 40', 42' without removing adapters 134.

During installation of tub filler assembly 11', rough-in assembly 50' is provided below floor 5. Alternatively, rough-in assembly 50' may be installed when the plumbing system is installed. Initially, rough-in assembly 50' may include covers 56'. As such, covers 56' are coupled to sealing members 54' and bases 52' with fasteners 100. With covers 56' coupled to bases 52', other components of rough-in assembly 50', such as inlet tubes 40', 42' and bosses 70 and cylindrical openings 78 of bases 52' may be protected from dirt, debris, contamination, and damage during installation of tub filler assembly 11'. Rough-in assembly 50' is coupled to subfloor structure 5*b* of floor 5 and is coupled thereto with fasteners 58. Fasteners 58 extend through apertures 108 (FIG. 17) in bases 52' and into a lower portion of floor 5 (e.g., subfloor structure 5*b* of floor 5). As shown in FIGS. 16 and 17, when bases 52' are coupled to floor 5, bases 52' are positioned below floor 5 and a portion of rough-in assembly 50', including a portion of covers 56', extend through openings 6' in floor and into the living space. Covers 56' conceal bosses 70, cylindrical openings 78, and inlet tubes 40', 42' until mounting assembly 11' is coupled to rough-in assembly 50'. As such, covers 56' protect rough-in assembly 50' from contamination and damage before installation of mounting assembly 11'.

When bases 52' are coupled to floor 5, water supply tubes (not shown) may be fluidly coupled thereto. In particular, a hot water supply may be sealingly coupled to water supply port 60 and a cold water supply may be sealingly coupled to water supply port 62 of bases 52'. Before mounting assembly 11' is coupled to rough-in assembly 50', caps 106' in inlet tubes 40', 42' may be used to test and/or determine the pressure or other parameters of the water in waterways 64, 66 and inlet tubes 40', 42'.

To couple mounting assembly 11' to rough-in assembly 50', the upper portion of covers 56' is removed. Trim tubes 92', 94' then may be coupled to inlet tubes 40', 42' with adapters 134. More particularly, tapered inner surfaces 122 of feet 120 of trim tubes 92', 94' provide a smooth surface for trim tubes 92', 94' to slide over adapters 134. As such, trim tubes 92', 94' do not interfere with or dislodge o-rings 138 from grooves 136 of adapters 134. In this way, trim tubes 92', 94' are fully sealed against adapters 134 because trim tubes 92', 94' do not include a blunt bottom surface that could interfere with and/or dislodge o-rings 82.

Tube guides 36' then may be positioned over trim tubes 92', 94'. Shoulders 116 of tube guides 36' engage shoulders 118 of trim tubes 92', 94' to sufficiently couple tube guides 36' to trim tubes 92', 94'. Tube guides 36' are positioned against the top surface of finished flooring surface 5*a* of floor 5 and are aligned such that openings 124 receive stop valves 68. As such, stop valves 68 extend above floor 5 and into the living space.

Trim members 18' may be received over tube guides 36'. Illustratively, when trim members 18' are assembled with tube guides 36', the bottom surface of trim members 18' contacts flange 36*a'* of tube guides 36'. In one embodiment, when trim members 18' are received over tube guides 36', the position of trim members 18' may be adjusted along axis (A) such that trim members 18' axially "float" along axis (A), thereby allowing the height of trim members 18' to remain constant relative to tub 1, irrespective of the thickness (t) of floor 5. Escutcheons 26' may be received over trim members 18'. Sealing member 32 may be positioned between trim members 18' and escutcheons 26'.

With mounting assembly 11' positioned above floor 5, the position of mounting assembly 11' remains constant relative to tub 1. More particularly, it may be appreciate that because rough-in assembly 50' is positioned below floor 5 and mounting assembly 11' is positioned above floor 5, the vertical length of mounting assembly 11' above floor 5 is constant, regardless of the thickness (t) of floor 5. Additionally, because the vertical position of trim members 18' may be adjustable, the height of spout 12', relative to tub 1, is constant, regardless of the thickness (t) of floor 5. As such, the coupling of rough-in assembly 50' to mounting assembly 11' accommodates various thicknesses (t) of floor 5, which allows mounting assembly 11' and spout 12' to remain at a constant vertical height relative to tub 1.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practices in the art to which this invention pertains.

What is claimed is:

1. A tub filler faucet assembly for coupling to a floor comprising:

a free-standing spout spaced apart from a tub wall;

a valve assembly fluidly coupled to the spout;

a free-standing mounting assembly spaced apart from the tub wall and coupled to the spout and a top surface of the floor; and a rough-in assembly positioned below the floor and coupled to the mounting assembly, the rough-in assembly including at least one passageway fluidly coupled to the valve assembly.

2. The tub filler faucet assembly of claim 1, wherein the position of the rough-in assembly is adjustable with a thickness of the floor.

3. The tub filler faucet assembly of claim 2, wherein the trim assembly is positioned above the floor.

4. The tub filler faucet assembly of claim 2, wherein a distance between the spout and the floor is constant and independent of the thickness of the floor.

5. The tub filler faucet assembly of claim 1, further comprising at least one stop valve fluidly coupled to the rough-in assembly, the at least one stop valve being accessible from above the floor.

6. The tub filler faucet assembly of claim 1, wherein the rough-in assembly further comprises at least one inlet tube and at least one test cap configured to be sealingly positioned within the at least one inlet tube when a pressure test is conducted.

7. The tub filler faucet assembly of claim 1, wherein the rough-in assembly includes upwardly extending mounting apertures for coupling to the mounting assembly.

8. The tub filler faucet assembly of claim 7, wherein the mounting assembly includes a mounting plate, the mounting plate being positioned above the floor and coupled to the upwardly extending mounting apertures of the rough-in assembly.

9. The tub filler faucet assembly of claim 7, wherein the rough-in assembly further includes at least one opening for supporting at least one stop valve.

10. A tub filler faucet assembly configured to couple with a floor comprising:

a spout;

a mounting assembly coupled to the spout; and a rough-in assembly coupled to the mounting assembly and including a base member coupled to the floor and a cover member coupled to the base member, at least a portion of the cover member being removable when the base member is coupled to the floor.

11. The tub filler faucet assembly of claim 10, wherein the cover member is configured to extend through an opening in the floor and at least a portion of the cover member extending above the floor is removed from the rough-in assembly.

12. The tub filler faucet assembly of claim 10, wherein the rough-in assembly further comprises at least one inlet tube and at least one stop valve fluidly coupled to the inlet tube, the cover member is configured to generally surround the at least one inlet tube.

13. The tub filler faucet assembly of claim 12, wherein the mounting assembly includes at least one trim tube operably coupled to the at least one inlet tube.

14. The tub filler faucet assembly of claim 13, wherein a sealing member is positioned between the at least one trim tube and the at least one inlet tube.

15. The tub filler faucet assembly of claim 13, wherein the at least one trim tube includes at least one aperture configured to flow water within the trim tube to the floor.

16. The tub filler faucet assembly of claim 10, further comprising at least one handle and a valve assembly operably coupled to the spout and the mounting assembly.

17. The tub filler faucet assembly of claim 10, further comprising a first handle and a second handle.

18. A method of installing a tub filler faucet assembly comprising the steps of:

positioning a rough-in assembly below a flooring surface;

coupling the rough-in assembly to a water supply assembly;

supporting a free-standing mounting assembly on a top surface of the flooring surface;

coupling the mounting assembly to a spout;

coupling, fluidly, a valve assembly to the spout;

coupling, fluidly, the valve assembly to a passageway of the rough-in assembly; and positioning the spout above an upper surface of a tub.

19. The method of claim 18, further comprising the step of coupling the mounting assembly to the rough-in assembly.

20. The method of claim 19, further comprising the step of coupling the rough-in assembly to the flooring surface.

21. The method of claim 20, wherein the rough-in assembly includes upwardly-extending mounting apertures and the mounting assembly includes a mounting plate, and the mounting plate is coupled to the upwardly-extending mounting apertures of the rough-in assembly.

22. The method of claim 21, further comprising the step of coupling at least one stop valve to the rough-in assembly.

23. The method of claim 22, wherein the at least one stop valve extends above the flooring surface.

24. The method of claim 21, wherein the rough-in assembly includes openings for receiving the at least one stop valve, and the openings are positioned intermediate the mounting apertures.

* * * * *